United States Patent [19]

Yoneyama

[11] Patent Number: 5,026,631

[45] Date of Patent: Jun. 25, 1991

[54] SILVER HALIDE COLOR PHOTOGRAPHIC MATERIAL

[75] Inventor: Hiroyuki Yoneyama, Kanagawa, Japan

[73] Assignee: Fuji Photo Film Co., Ltd., Kanagawa, Japan

[21] Appl. No.: 540,735

[22] Filed: Jun. 20, 1990

[30] Foreign Application Priority Data

Jun. 21, 1989 [JP] Japan ..... 1-158923

[51] Int. Cl.[5] ..... G03C 7/34

[52] U.S. Cl. ..... 430/545; 430/546; 430/628

[58] Field of Search ..... 430/545, 546, 628

[56] References Cited

U.S. PATENT DOCUMENTS

| | | | |
|---|---|---|---|
| 3,619,195 | 11/1971 | Van Campen | 430/545 |
| 4,120,725 | 10/1978 | Nakazyo et al. | 430/545 |
| 4,201,589 | 5/1980 | Sakaguchi et al. | 430/545 |
| 4,203,716 | 5/1980 | Chen | 430/545 |
| 4,358,533 | 11/1982 | Takitou et al. | 430/546 |
| 4,368,258 | 1/1983 | Fujiwhara et al. | 430/546 |
| 4,822,728 | 4/1989 | Loiacono et al. | 430/545 |
| 4,946,770 | 8/1990 | Takahashi et al. | 430/546 |

*Primary Examiner*—Richard L. Schilling
*Attorney, Agent, or Firm*—Sughrue, Mion, Zinn, Macpeak & Seas

[57] ABSTRACT

A silver halide color photographic material having a support and at least one hydrophilic colloid layer provided thereon, the hydrophilic colloid layer containing a dispersion obtained by dissolving a diffusion resistant oil-soluble cyan coupler which forms a substantially nondiffusible dye by coupling with an oxidation product of an aromatic primary amine developing agent and a hydrophobic polymer latex formed in an aqueous medium in each other, in which the polymer latex has a recurring unit represented by the following general formula (I), the cyan coupler is represented by the following general formula (II) or (III), and the disperison is formed through a water-in-oil emulsion at least once when the hydrophobic polymer latex formed in the aqueous medium is mixed with a solution of the cyan coupler in a coupler solvent:

(I)

(II)

(III)

wherein $R_1$, $R_2$, $R_3$, $R_4$, $R_5$, $R_6$, $R_7$, $R_8$, $Y_1$, $Y_2$ and n are as defined above.

8 Claims, No Drawings

SILVER HALIDE COLOR PHOTOGRAPHIC MATERIAL

FIELD OF THE INVENTION

The present invention relates to a silver halide color photographic material improved in deterioration of image qualities during storage of prints due to changes in density of cyan dyes after a color developing stage.

BACKGROUND OF THE INVENTION

When color photographic materials are stored as records, it is desired that light fading and dark fading are depressed to a minimized degree to keep three-color fading balance of yellow, magenta and cyan dye images in an initial condition. However, the degrees of the light fading and dark fading of the yellow, magenta and cyan dye images differ from one another depending on each dye image, and therefore the color balance is sometimes lost. In particular, with respect to light fading, the fading behavior of the three colors, yellow, magenta and cyan, sometimes varies with the illuminance of light. Namely, even if the fading proceeds without losing their color balance under light of low illuminance, the cyan image deteriorates faster under light of high illuminance to cause loss of color balance, which results in deterioration of dye image qualities, in some cases.

There have previously proposed techniques for improving the light fading and thermal fading by using various additives. For example, improved techniques using coupler dispersion oils are disclosed in JP-A-59-105645, JP-A-60-205447, JP-A-62-129853 and JP-A-62-196657 (the term "JP-A" as used herein refers to a "published unexamined Japanese patent application"); improved techniques using antifading agents are disclosed in JP-A60-222853, JP-A-62-87961, JP-A-62-118344, JP-A-62-178962 and JP-A-62-210465; and improved techniques using coupler dispersion oils in combination with antifading agents are disclosed in JP-A-61-167953 and JP-A-62-198859. However, any one of these techniques has only a partial effect or is improved only to a low level, and hence no satisfactory techniques have been developed yet in the present condition.

Further, U.S. Pat. Nos. 4,203,716 and 4,358,533 disclose a method comprising dissolving a hydrophobic miscible organic solvent, and mixing the resulting solution with a loadable polymer latex to load a polymer with the hydrophobic material. However, such a method using the loadable polymer latex has the problem that particularly the light fastness of the cyan image is inferior, compared to a method using water and a high boiling coupler solvent. In addition, the method using the loadable polymer latex also has the disadvantage that the polymer is required to be used in large amounts to load the polymer with the coupler to obtain a sufficient maximum color forming density.

Further, techniques for improving film qualities and image fastness in which photographic materials containing dispersions of oil-soluble couplers and water-insoluble, organic solvent-soluble polymers are used are described in, for example, U.S. Pat. Nos. 3,619,195, 4,201,589 and 4,120,725, and JP-A-51-19534, JP-A-51-134627 and JP-A-55-64236. No photographic materials, however, have high image fastness and satisfactory color forming properties.

U.S. Pat. No. 4,120,725 describes the use of a polymer having a specified structure in combination with a water-soluble polymer for promoting silver removal.

When the technique described above is applied to silver chlorobromide containing at least 80 mol% of silver chloride, a problem is encountered in that not only rapid development is largely hindered, but also the photographic sensitivity is reduced (in general, when the silver halide content is high, this reduction is presumed to be caused by desorption of a sensitizing dye with the polymer for promoting silver removal due to weak absorbability of the sensitizing dye to the polymer for promoting silver removal) or poor silver removal takes place (which is presumed to be caused by absorption of the polymer for promoting silver removal to an emulsion).

PCT International Publication No. W088/00723 and JP-A-63-44658 disclose methods for improving image fastness by emulsifying a solution in which a water-insoluble, organic solvent-soluble polymer is dissolved together with a cyan coupler.

The image fastness is surely significantly improved by these methods, but it is insufficient to prevent the cyan image from undergoing a reduction in density which takes place on storage under light of high illuminance. Further technical developments have therefore been desired.

SUMMARY OF THE INVENTION

Accordingly, an object of the present invention is to provide a silver halide color photographic material which undergoes a small reduction in density of the cyan image even when the material is stored under light of high illuminance.

As a result of diligent studies, the present inventors discovered that the above-described object is effectively achieved by using an oil-in-water emulsified dispersion of a cyan coupler, the dispersion being prepared through a water-in-oil emulsion, thus resulting in completion of the present invention.

That is, the present invention provides a silver halide color photographic material having a support and at least one hydrophilic colloid layer provided thereon, the hydrophilic colloid layer containing a dispersion obtained by dissolving a diffusion resistant oil-soluble cyan coupler which forms a substantially nondiffusible dye by coupling with an oxidation product of an aromatic primary amine developing agent and a hydrophobic polymer latex formed in an aqueous medium in each other, in which the polymer latex has a recurring unit represented by the following general formula (I), the cyan coupler is represented by the following general formula (II) or (III), and the dispersion is formed through a water-in-oil emulsion at least once when the hydrophobic polymer latex formed in the aqueous medium is mixed with a solution of the cyan coupler in a coupler solvent:

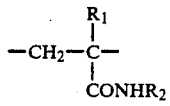

(I)

wherein $R_1$ represents a hydrogen atom, a halogen atom or a methyl group; and $R_2$ represents a substituted or unsubstituted aliphatic, aromatic or heterocyclic group;

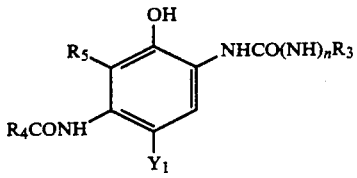

(II)

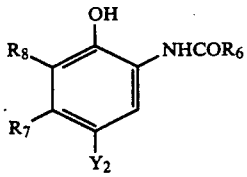

(III)

wherein $R_3$, $R_4$ and $R_6$ each represents a substituted or unsubstituted aliphatic, aromatic or heterocyclic group; $R_5$, $R_7$ and $R_8$ each represents a hydrogen atom, a halogen atom, an aliphatic group, an aromatic group or an acylamino group; $R_5$ may represent a nonmetallic atom which combines together with $R_4$ to form a nitrogen-containing 5-membered or 6-membered ring; $Y_1$ and $Y_2$ each represents a hydrogen atom or a group which is eliminable by coupling reaction with an oxidation product of a developing agent; and n represents 0 or 1.

Preferably, the hydrophobic polymer latex formed in the aqueous medium has a relative fluorescent quantum yield (K value) of at least 0.2.

It is also preferred that the hydrophobic polymer latex formed in the aqueous medium is crosslinked by a crosslinking group.

The hydrophobic polymer latex formed in the aqueous medium preferably contains the coupler solvent.

DETAILED DESCRIPTION OF THE INVENTION

In the silver halide color photographic materials of the present invention, hydroquinones or quinones may be used for the purposes of controlling gradation, preventing fogging, improving color image stability and improving poor recoloring. In particular, to improve poor recoloring of the cyan couplers due to bleaching solutions or bleaching fixers, the hydroquinone compounds or the quinone compounds described in JP-A-63-316857 and Japanese Patent Application No. 1-90088 can be preferably used.

The polymer latexes used in the present invention are hereinafter described in detail.

In general formula (I), $R_1$ represents a hydrogen atom, a halogen atom (for example, chlorine) or a methyl group. $R_2$ represents a substituted or unsubstituted aliphatic, aromatic or heterocyclic group. When $R_2$ is an aliphatic group, a straight chain, branched or cyclic alkyl group is particularly preferred, and a branched alkyl group having 4 to 10 carbon atoms is more preferred.

The alkyl group is most preferably an unsubstituted alkyl group.

In the present invention, the hydrophobic polymer latex means a latex formed by dispersing a polymer having a solubility of 50 mg or less per 100 g of water at 25° C. in an aqueous medium. The polymer latex may be directly prepared by emulsion polymerization, or may be prepared by dissolving a linear polymer separately synthesized in an auxiliary solvent, and then emulsifying and dispersing the resulting solution in an aqueous medium by using gelatin or a water-soluble binder.

Preferred emulsion polymerization initiators for synthesizing the hydrophobic polymers employed in the present invention include persulfates such as potassium persulfate and ammonium persulfate, azo compounds such as 4,4'-azobis(4-cyanovaleric acid), and peroxides such as benzoyl peroxide and hydrogen peroxide.

As polymerization emulsifiers, compounds having surface activity are used. Preferred examples thereof include soap, sulfonates, sulfates, cationic compounds, ampholytic compounds and polymeric protective colloids.

The polymerization is preferably conducted at a temperature ranging from 40° to 95° C.

The hydrophobic polymers used for the latexes in the present invention may be homopolymers consisting of the recurring units represented by general formula (I) or copolymers of the recurring units represented by general formula (I) and other monomers. The acrylamides and the methacrylamides described in PCT International Publication No. W088/00723, pages 16 and 17 are preferably used as monomers. The monomers preferably used for copolymerization include acrylic esters, methacrylic esters, vinyl esters and olefins. Specific examples of these monomers are also described in PCT International Publication No. W088/00723. In particular, as monomers each having at least two unsaturated components which are crosslinkable during copolymerization reaction, the monomers described in JP-A-60-151636 can be preferably used. The hydrophobic polymers can contain 5 to 100% by weight, preferably 50 to 100% by weight of the recurring units represented by general formula (I), and 0 to 5% by weight, preferably 0.05 to 2% by weight of the crosslinkable monomers.

The hydrophobic polymers used for the hydrophobic polymer latexes in the present invention preferably have a molecular weight of 5,000 to 500,000, more preferably 10,000 to 80,000.

It is preferable that the hydrophobic polymer latexes used in the present invention have a relative fluorescent quantum yield (K value) as high as possible. In particular, latexes having a K value of at least 0.2 is preferred. The above-described K value can be measured according to the method described in JP-A-02-77059.

For the hydrophobic polymer latexes in the present invention, two or more kinds of latexes mixed with one another may be used.

A suitable method for dissolving the hydrophobic polymer latex and the cyan coupler in each other is hereinafter described.

The hydrophobic polymer latex formed by dispersing the polymer in the aqueous medium is added to the solution of the cyan coupler in the coupler solvent with stirring to form the water-in-oil emulsion. The "water-in-oil emulsion" referred to here means an emulsion in which an oil phase containing the hydrophobic solvent for the coupler forms a continuous phase and a component containing water is dispersed therein.

An aqueous medium is further added to this water-in-oil emulsion, followed by mixing and stirring. Finally, the oil-in-water emulsion in which the cyan coupler and the polymer latex are dissolved in each other can be obtained. Here, the state in which the cyan coupler and the polymer latex are dissolved in each other means a state in which the cyan coupler and the polymer coexist in the same particle without precipitation of crystals of the cyan coupler. In order to aid emulsification, there can be used emulsifiers employed for preparation of usual emulsions, such as alkylbenzenesulfonates, alkylnaphthalenesulfonates, aliphatic alcohol sulfates, alkylsulfosuccinic acids and sorbitan monoalkyl esters.

It is usually preferred that the aqueous media for the emulsions in the present invention contain hydrophilic colloids, though water alone may be used. As the hydrophilic colloids, all of the colloids usually used as binders for photographic layers can be employed. Specific examples include gelatin, gelatin derivatives (for example, acetylated gelatin, phthalated gelatin and succinated gelatin), albumin, collodion, gum arabic, agar, alginic acid, cellulose derivatives (for example, alkyl esters of carboxy cellulose, hydroxyethyl cellulose and carboxymethyl cellulose) and synthetic resins (for example, polyvinyl alcohol, polyvinyl pyrrolidone and acrylic acid-ethyl acrylate copolymers). These hydrophilic colloids may be used individually or as mixtures of two or more kinds of them.

It is preferred to add the coupler solvent to the hydrophobic latex polymer dispersed in the aqueous medium, before the polymer is mixed with the solution of the cyan coupler. As the coupler solvents, there can be used, for example, both low boiling organic solvents such as ethyl acetate, methyl ethyl ketone and methyl alcohol as described in U.S. Pat. Nos. 3,253,921 and 3,574,627 and high boiling organic solvents immiscible with water and having high affinity for the couplers as described in JP-A-62-215272. Further, UV absorbents (which may be solid or liquid) and photographic additives which are solid at ordinary temperature are also used as the coupler solvents, as long as they have high affinity for the couplers.

A plurality of these coupler solvents may be used in combination with one another.

In the present invention, the latex polymer can contain any amount of the coupler solvent, before it is mixed with the solution of the cyan coupler. The low boiling organic solvents are present preferably in an amount of 0 to 500%, more preferably in an amount of 20 to 100%, based on the weight of the latex polymers. In the case of the high boiling organic solvents, the amount thereof is preferably 0 to 2,000%, more preferably 10 to 100%, based on the weight of the latex polymers. When the photographic additives are used for the coupler solvents, the amount thereof is preferably 0 to 200%, more preferably 1 to 100%, based on the weight of the latex polymers.

As to emulsifying apparatus, all known apparatus can be used. Typical examples thereof include mixers, homogenizers, colloid mills, ultrasonic emulsifier and emulsifying apparatus equipped with Poleman whistles.

The hydrophobic latex polymers are preferably 0.5 μm or less in grain size, more preferably 0.005 to 0.2 μm. In order to cause a grain to contain the cyan coupler, it is preferred that the grain size is as small as possible.

The hydrophobic polymer latexes used for causing the latexes to contain the couplers by mixing the latexes with the coupler solutions in the present invention may contain the coupler solvents in any amount, but the coupler solvents are used preferably in an amount of 0 to 500% by weight, more preferably in an amount of 5 to 200% by weight, based on the hydrophobic polymers.

In the present invention, the hydrophobic polymer latexes (polymer components) can be used in an amount of 0.5 to 300% by weight, preferably 5 to 200% by weight, based on the cyan couplers.

Synthesis examples of the polymer latexes used in the present invention are hereinafter described in detail.

SYNTHESIS EXAMPLE (1)

Preparation of n-Dodecylacrylamide Polymer (P-1) Latex 2.5 g of sodium dodecylsulfate, 50 g of n-dodecylacrylamide and 200 ml of water were placed in a 500 ml three neck flask, and heated at 80° C. with stirring in a stream of nitrogen.

After 10 ml of an aqueous solution containing 500 mg of potassium persulfate was added thereto, polymerization was conducted for 2 hours, followed by cooling. Then, the latex was taken out of the flask.

The pH of the latex was adjusted to 7.0 with 0.5 N sodium hydroxide, followed by filtration. Thus, 256.2 g of the latex (P-1) was obtained.

The latex solution contained 18.7% by weight of the polymer component.

SYNTHESIS EXAMPLE (2)

Preparation of t-Butylacrylamide Polymer (P-2) Latex

A mixture of 50.0 g of t-butylacrylamide and 250 ml of toluene were placed in a 500 ml three neck flask, and heated at 80° C. with stirring in a stream of nitrogen. As a polymerization initiator, 10 ml of a toluene solution containing 500 mg of azobisisobutyronitrile was added thereto to initiate polymerization.

After polymerization for 3 hours, the polymerization solution was cooled, and then 1 liter of hexane was poured therein. The precipitated solid was separated by filtration and washed with hexane, followed by heating with stirring under reduced pressure. Thus, 47.9 g of (P-2) was obtained.

After the completion of polymerization, 10.0 g of the polymer was dissolved in 30.0 cc of ethyl acetate. The resulting solution was emulsified and dispersed together with 20% gelatin solution containing 1.0 g of sodium dodecylbenzenesulfonate to prepare a polymer latex.

Specific examples of the hydrophobic polymers preferably used for the hydrophobic polymer latexes in the present invention are hereinafter illustrated. However, the scope of the present invention is not limited thereto.

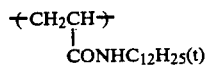

(P-1)

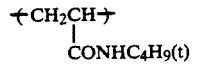

(P-2)

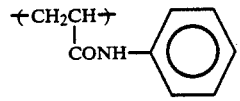

(P-3)

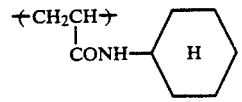

(P-4)

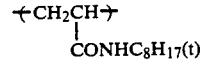

(P-5)

-continued (P-6)

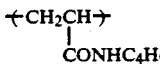

(P-7)

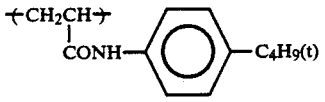

(P-8)

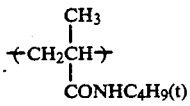

(P-9)

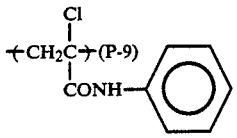

(P-10)

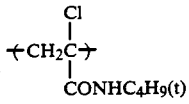

(The ratios of the comonomer components shown below represent weight ratios.)

(P-11)

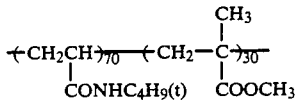

(P-12)

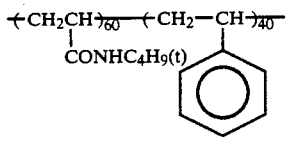

(P-13)

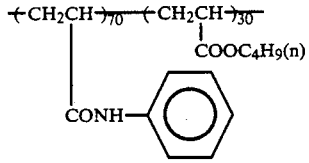

(P-14)

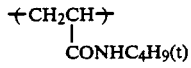

Crosslinked with 0.1% by weight of divinylbenzene.

(P-15)

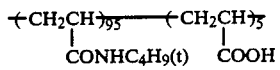

(P-16)

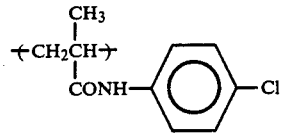

In the present invention, the cyan couplers represented by the following formulae (II) and (III) are preferably used:

(II)

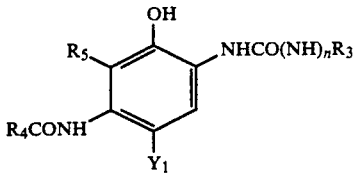

(III)

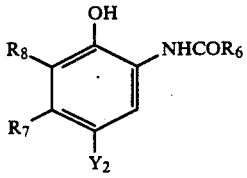

In general formulae (II) and (III), $R_3$, $R_4$ and $R_6$ each represents a substituted or unsubstituted aliphatic, aromatic or heterocyclic group; $R_5$, $R_7$ and $R_8$ each represents a hydrogen atom, a halogen atom, an aliphatic group, an aromatic group or an acylamino group; $R_5$ may represent a nonmetallic atom which combines together with $R_4$ to form a nitrogen-containing 5-membered or 6-membered ring; $Y_1$ and $Y_2$ each represents a hydrogen atom or a group which is eliminable by coupling reaction with an oxidation product of a developing agent; and n represents 0 or 1.

$R_7$ in general formula (III) is preferably an aliphatic group. Examples thereof include methyl, ethyl, propyl, butyl, pentadecyl, tert-butyl, cyclohexyl, cyclohexylmethyl, phenylthiomethyl, dodecyloxyphenylthiomethyl, butanamidomethyl and methoxymethyl.

Preferred examples of the cyan couplers represented by the above-described formulae (II) or (III) are as follows.

$R_3$ in general formula (II) is preferably an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group or a cyano group.

When $R_5$ and $R_4$ combine together to form a ring in general formula (II), such a nitrogen-containing heterocyclic ring is preferably a 5-membered to 7-membered ring. When no ring is formed, $R_4$ is preferably a substituted or unsubstituted alkyl group, and particularly an alkyl group substituted by a substituted aryloxy is more preferable. $R_5$ is preferably a hydrogen atom.

$R_6$ in general formula (III) is preferably a substituted or unsubstituted alkyl or aryl group, and particularly an alkyl group substituted by a substituted aryloxy is preferable.

$R_7$ in general formula (III) is preferably an alkyl group having 1 to 15 carbon atoms or a methyl group having a substituent group of at least one carbon atom. As the substituent group, there is preferably used an arylthio group, an alkylthio group, an acylamino group, an aryloxy group or an alkyloxy group.

In particular, $R_7$ in general formula (III) is preferably an alkyl group having 1 to 15 carbon atoms, and more preferably an alkyl group having 2 to 4 carbon atoms.

$R_8$ in general formula (III) is preferably a hydrogen atom or a halogen atom, and particularly a chlorine atom or a fluorine atom is more preferable.

In general formulae (II) and (III), $Y_1$ and $Y_2$ are each preferably a hydrogen atom, a halogen atom, an alkoxy group, an aryloxy group, an acyloxy group or a sulfonamido group.
Specific examples of the cyan couplers represented by general formulae (II) and (III) are hereinafter enumerated.
(C-1)
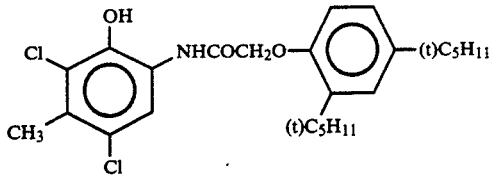
(C-2)
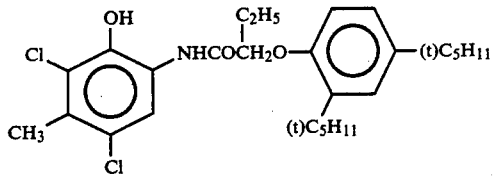
(C-3)
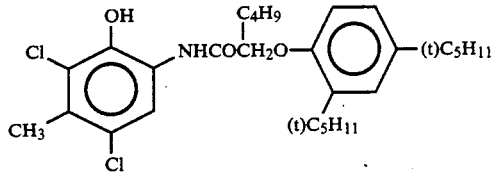
(C-4)
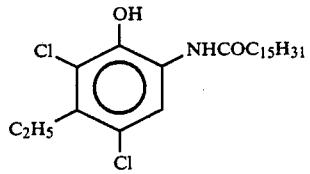
(C-5)
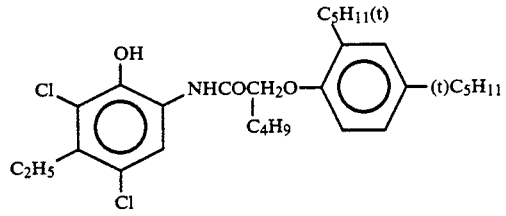
(C-6)
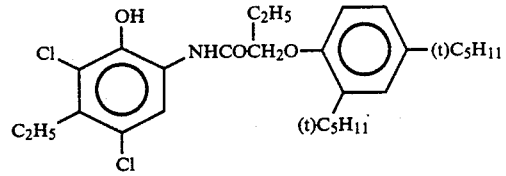
(C-7)
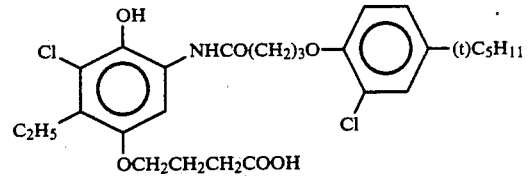
(C-8)
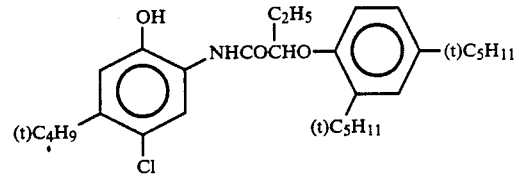

-continued
(C-9)
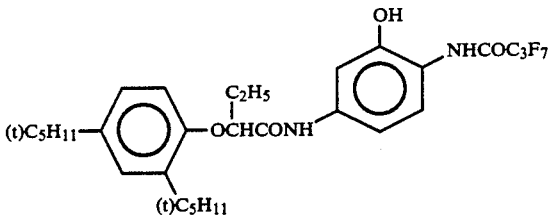
(C-10)
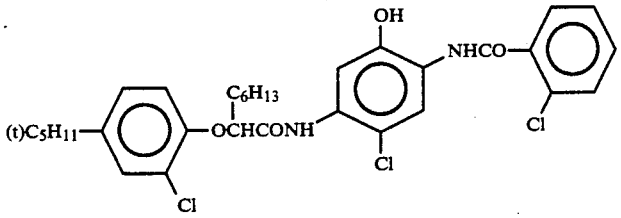
(C-11)
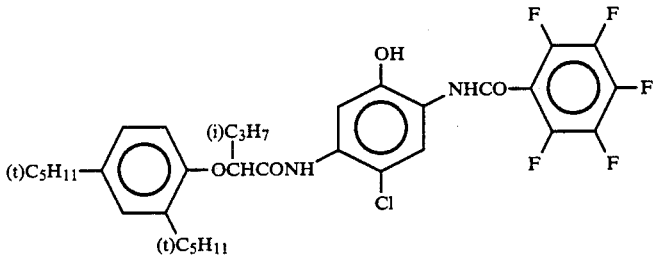
(C-12)
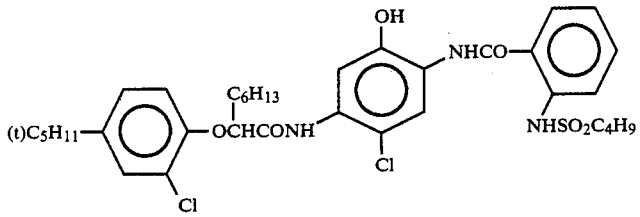
(C-13)
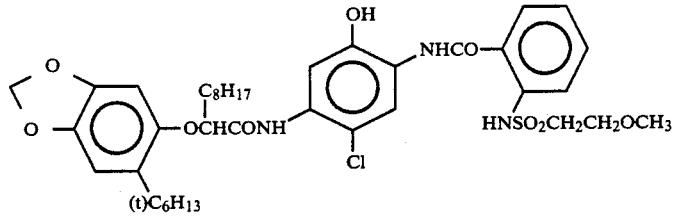
(C-14)
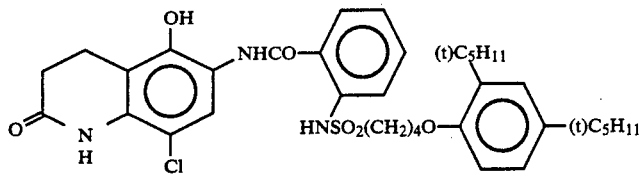
(C-15)
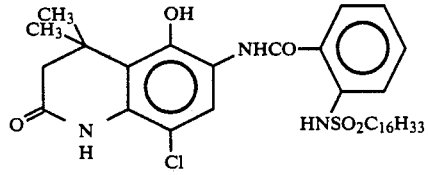

-continued
(C-16)
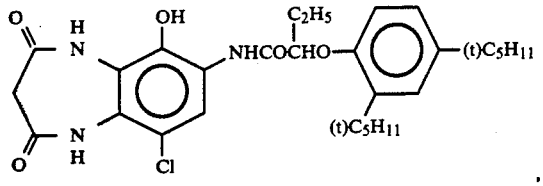
(C-17)
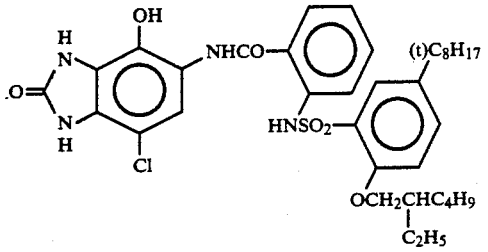
(C-18)
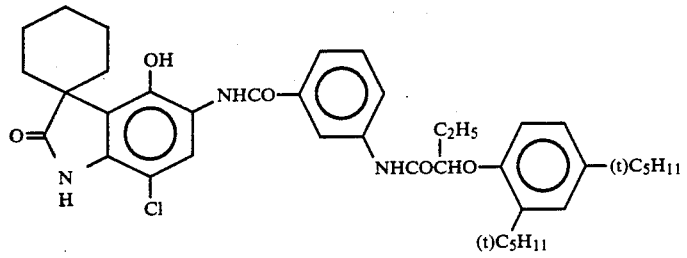
(C-19)
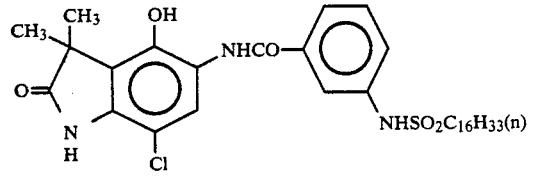
(C-20)
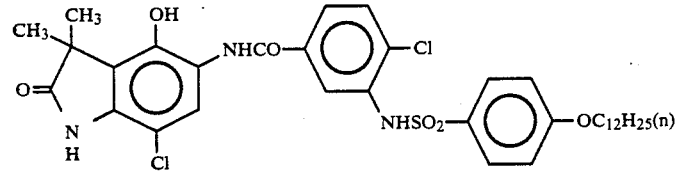
(C-21)
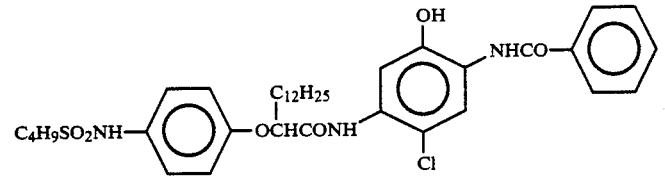
(C-22)
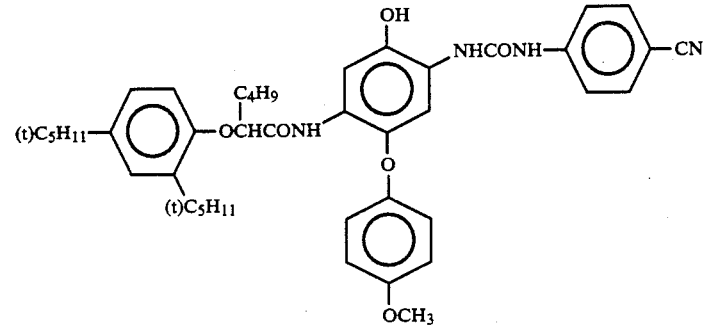
The couplers represented by the above-described formula (II) or (III) are generally contained in silver The coupler solvents used when the emulsified dispersions of the couplers are prepared according to the above-described methods are preferably high boiling organic solvents (which may be used in combination with low boiling organic solvents such as ethyl acetate).

As the high boiling organic solvents, compounds represented by the following formulae (A) to (E) are preferably used.

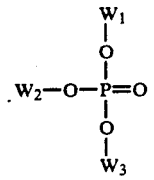

(A)

$W_1-COO-W_{2(B)}$

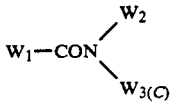

$W_{3(C)}$

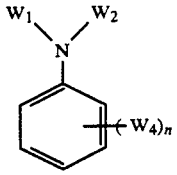

(D)

$W_1-O-W_2$ (E)

wherein $W_1$, $W_2$ and $W_3$ each represents a substituted or unsubstituted alkyl, cycloalkyl, alkenyl, aryl or heterocyclic group; $W_4$ represents $W_1$, $OW_1$ or $S-W_1$; n is an integer of 1 to 5; $W_4$ may be the same or different when n is 2 or more; and $W_1$ and $W_2$ may combine together to form a condensed ring in general formula (E).

Even high boiling solvents other than the solvents represented by general formulae (A) to (E) can be used in the present invention, as long as they are water-immiscible compounds having a melting point of not more than 100° C. and a boiling point of at least 140° C., and are good coupler solvents. The melting point of the high boiling solvents is preferably 80° C. or less. The boiling point of the high boiling solvents is preferably 160° C. or more, more preferably 170° C. or more.

Details of these high boiling solvents are described on page 137, lower right column to page 144, upper right column of JP-A-62-215272.

The color photographic material of the present invention can be formed by applying at least one layer for each of blue-sensitive, green-sensitive and red-sensitive silver halide emulsion layers on a support. For ordinary photographic printing paper, the silver halide emulsion layers are usually applied on the support in the above-described order, but they may be applied in a different order. Further, an infrared-sensitive silver halide emulsion layer can be used in place of at least one of the above-described emulsion layers. Each of these light-sensitive emulsion layers contains a silver halide emulsion having sensitivity to each wavelength region and a dye complementary to light to which the emulsion layer is sensitive, namely, a so-called color coupler forming yellow to blue, magenta to green or cyan to red, and thereby color reproduction can be achieved according to a subtractive color process. However, the light-sensitive emulsion layers and the formed colors may be combined so as not to have the correspondence described above.

As the silver halide emulsions used in the present invention, emulsions comprising silver chlorobromide or silver chloride substantially free from silver iodide are preferably used. Here, "substantially free from silver iodide" means that the content of silver iodide is 1 mol% or less, preferably 0.2 mol% or less. Grains contained in the emulsion may be the same or different from one another in halogen composition. However, when an emulsion containing grains each of which has the same halogen composition is used, it is easy to homogenize the properties of each grain. With respect to the internal halogen composition distribution of the silver halide grains, there can be suitably selected to use grains of a so-called uniform type structure in which the composition is the same at any portion of the grain, grains of a so-called laminated type structure in which an internal core of the grain is different from a shell (one layer or a plurality of layers) surrounding it in halogen composition, or the grains of a structure in which the inside of the grain or the surface thereof has non-layer portions different in halogen composition (a structure in which the portions different in halogen composition are connected to the edges, the corners or the surface of the grain when they are on the surface of the grain). In order to obtain high sensitivity, it is more advantageous to use either of the latter two grains than to use the grains of the uniform type structure. The latter two grains are preferable also in respect to pressure resistance. When the silver halide grains have the structure as described above, a boundary between portions different from each other in halogen composition may be clear or unclear due to formation of mixed crystals by the difference in composition. Further, continuous changes in structure may be positively given thereto.

As to the halogen composition of these silver chlorobromide emulsions, emulsions having any silver bromide/silver chloride ratio can be used. Although this ratio can vary over a wide range depending on the object, emulsions having a silver bromide/silver chloride ratio of at least 0.02 can be preferably used.

Further, so-called high silver chloride emulsions having a high silver chloride content are preferably used for light-sensitive materials suitable for rapid processing. The silver chloride content of these high silver chloride emulsions is preferably at least 90 mol%, more preferably 95 mol%.

In such high silver chloride emulsions, the grains of a structure in which the inside and/or the surface of the silver halide grain has silver bromide-localized layers in a layer form or in a non-layer form are preferred. The halogen composition of the above-described localized layers is preferably at least 10 mol%, more preferably above 20 mol% in silver bromide content. These localized layers can exist inside the grain and on the edges, the corners and the surface of the grain. As one preferred example, there can be mentioned localized layers formed on the corner portions of the grain by epitaxial growth.

On the other hand, for the purpose of minimizing a reduction in sensitivity when pressure is applied to the light-sensitive materials, the grains of the uniform type structure in which the halogen composition distribution in the grain is small are preferably used, also in the high silver chloride emulsions having a silver chloride content of at least 90 mol%.

Further, for the purpose of reducing the quantity of replenisher of a developing solution, it is also effective to increase the silver chloride content of the silver halide emulsions. In such a case, emulsions containing approximately pure silver chloride such that the silver chloride content is 98 to 100 mol% are preferably used.

It is preferred that the silver halide grains contained in the silver halide emulsions used in the present invention have a mean grain size of 0.1 to 2 μm. The mean grain size is a number mean value of grain sizes represented by the diameters of circles equivalent to the projected areas of the grains.

Further, it is preferred that these emulsions are so-called monodisperse emulsions having a narrow grain size distribution, namely, a coefficient of variation (the standard deviation of the grain size distribution divided by the mean grain size) of not more than 20%, desirably not more than 15%. At this time, for the purpose of obtaining a wide latitude, it is preferred that the above-described monodisperse emulsions can be blended in the same layer or can be coated in multiple layers.

The silver halide grains contained in the photographic emulsions may have a regular crystal form such as a cubic, an octahedral or a tetradecahedral, an irregular crystal form such as a spherical form or a plate (tabular) form, or a composite form thereof. Further, a mixture of grains having various crystal forms may also be used. In the present invention, it is desirable that the emulsions contain at least 50% (by number of grains), preferably at least 70%, more preferably at least 90% of the above-described grains having a regular crystal form.

Other than these, there can be preferably used an emulsion in which more than 50% (by number of grains) of all grains as a projected area are composed of plateform grains having a mean aspect ratio (a ratio of diameter (calculated as circle)/thickness) of at least 5, preferably at least 8.

The silver chlorobromide emulsions used in the present invention can be prepared according to the methods described in P. Glafkides, *Chimie et Physique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964). Namely, any of an acid process, a neutral process and an ammonia process may be used. A soluble silver salt and a soluble halogen salt may be reacted with each other by using any of a single jet process, a double jet process or a combination thereof. A so-called reverse mixing process in which grains are formed in the presence of excess silver ions can also be used. As a type of double jet process, there can also be used a process for maintaining the pAg in a liquid phase constant, in which a silver halide is formed, namely, a so-called controlled double jet process. According to this process, a silver halide emulsion having a regular crystal form and an approximately uniform grain size can be obtained.

In the course of formation of grain emulsions or physical ripening, various multivalent metal ion impurities can be introduced in the silver halide emulsions used in the present invention. Examples of compounds used include salts of cadmium, zinc, lead, copper and thallium, salts of the Group VIII metals of the Periodic Table, such as iron, ruthenium, rhodium, palladium, osmium, iridium and platinum, and complex salts thereof. In particular, salts of the Group VIII metals of the Periodic Table and complex salts thereof can be preferably used. Although the addition amount of these compounds varies over a wide range depending on the object, it is preferred that the compounds are added in an amount of $10^{-9}$ to $10^{-2}$ mol based on the mols of silver halide.

The silver halide emulsions used in the present invention are generally subjected to chemical sensitization and spectral sensitization.

With respect to chemical sensitization, sulfur sensitization represented by addition of unstable sulfur compounds, noble metal sensitization represented by gold sensitization, and reduction sensitization can be used individually or in combination. The compounds described on page 18, lower right column to page 22, upper right column of JP-A-62-215272 are preferably used for chemical sensitization.

Spectral sensitization is carried out for the purpose of giving spectral sensitivity in a desired light wavelength range to an emulsion of each layer of the light-sensitive material of the present invention. In the present invention, it is preferred that spectral sensitization is carried out by adding a dye which absorbs light in a wavelength range corresponding to a desired spectral sensitivity, namely, a spectrally sensitizing dye. The spectrally sensitizing dyes used in this case include dyes described in F. M. Harmer, *Heterocyclic Compounds—Cyanine Dyes and Related Compounds* (John Wiley & Sons, New York and London (1964). Specific examples of the compounds and spectrally sensitizing methods which are preferably used are described on page 22, upper right column to page 38 of JP-A-62-215272.

In order to prevent fogging during manufacturing stages, storage or photographic processing of the light-sensitive materials or to stabilize photographic properties thereof, various compounds or their precursors may be added to the silver halide emulsions used in the present invention. Specific examples of these compounds which are preferably used are described on page 39 to page 72 of JP-A-62-215272 described above.

The emulsions used in the present invention may be either of the so-called surface latent image emulsions in which latent images are mainly formed on the surface of grains or the so-called internal latent image emulsions in which the latent images are mainly formed in the interior of the grains.

The color photographic materials usually contain yellow couplers, magenta couplers and cyan couplers which are coupled with oxidation products of aromatic amine color developing agents to form a yellow color, a magenta color and a cyan color, respectively.

Magenta couplers and yellow couplers preferably used in combination with the cyan couplers in the present invention are represented by the following general formulae (M-I) and (M-II) and the following general formula (Y), respectively.

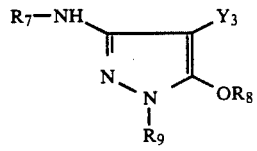

(M-I)

-continued

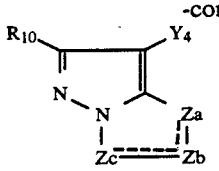

(M-II)

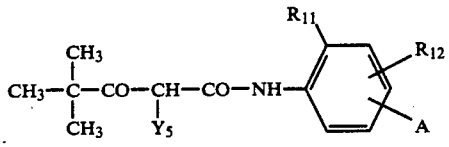

(Y)'

In general formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen atom or an eliminable group.

Substituent groups permissible for the aryl groups (preferably phenyl groups) of $R_7$ and $R_9$ are the same as the substituent groups permissible for the substituent group $R_1$ of formula (I). If there are two or more substituent groups, they may be the same or different. $R_8$ is preferably a hydrogen atom, an aliphatic acyl group or an aliphatic sulfonyl group, more preferably a hydrogen atom. $Y_3$ is preferably a group which is eliminable at a sulfur atom, an oxygen atom or a nitrogen atom. For example, groups of the sulfur atom eliminable type as described in U.S. Pat. No. 4,351,897 and PCT International Publication No. W088/04795 are particularly preferable.

In general formula (M-II), $R_{10}$ represents a hydrogen atom or a substituent group. $Y_4$ represents a hydrogen atom or a cleaving group, preferably a halogen atom or an arylthio group. Each of Za, Zb and Zc represents methine, substituted methine, =N— or —NH—. One of the Za—Zb bond and the Zb—Zc bond is a double bond and the other is a single bond. When the Zb—Zc bond is a carbon-carbon double bond, it may constitute a part of an aromatic ring. The couplers of formula (M-II) include a dimer or a multimer formed b $R_{10}$ or $Y_4$ and, when Za, Zb or Zc represents a substituted methine, a dimer or a multimer formed by the substituted methine.

Of the pyrazolotriazole couplers represented by general formula (M-II), the imidazo[1,2-b]pyrazoles described in U.S. Pat. No. 4,500,630 are preferable in respect to the decreased yellow side absorption and the light fastness of color forming dyes. In particular, pyrazolo[1,5-b][1,2,4]triazole described in U.S. Pat. No. 4,540,654 is preferable.

In addition, there are preferably used a pyrazolotriazole coupler having a branched alkyl group directly connected to the 2-, 3- or 6-position of a pyrazolotriazole ring as described in JP-A-61-65245, a pyrazoloazole coupler containing a sulfonamido group in its molecule as described in JP-A-61-65246, a pyrazoloazole coupler having an alkoxyphenylsulfonamido ballast group as described in JP-A-61-147254, and a pyrazolotriazole coupler having an alkoxy group or an aryloxy group at the 6-position of a pyrazolotriazole ring as described in European Patents 226,849 and 294,785.

In general formula (Y), $R_{11}$ represents a halogen atom, an alkoxy group, a trifluoromethyl group or an aryl group, and $R_{12}$ represents a hydrogen atom, a halogen atom or an alkoxy group. A represents —NHCOR$_{13}$, —NHSO$_2$R$_{13}$, —SO$_2$NHR$_{13}$, —COOR$_{13}$ $$-SO_2\underset{\underset{R_{14}}{|}}{N}-R_{13},$$

provided $R_{13}$ and $R_{14}$ each represents an alkyl group, an aryl group or an acyl group. $Y_5$ represents an eliminable group. Substituent groups of $R_{12}$, $R_{13}$ and $R_{14}$ are the same as the substituent groups permissible for $R_1$ of formula (I). The eliminable group $Y_5$ is preferably a group which is eliminable at an oxygen atom or a nitrogen atom. In particular, groups of the nitrogen eliminable type are preferable.

Specific examples of the couplers represented by general formulae (M-I), (M-II) and (Y) are enumerated below.

(M-1)

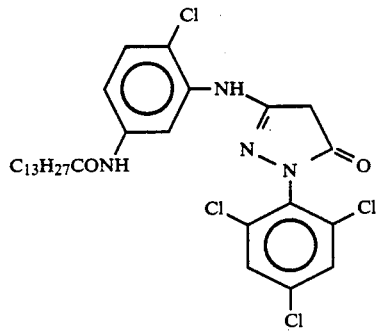

-continued
(M-2)
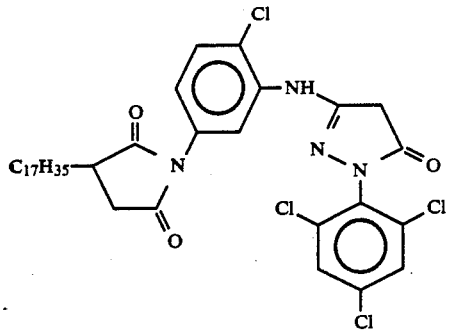
(M-3)
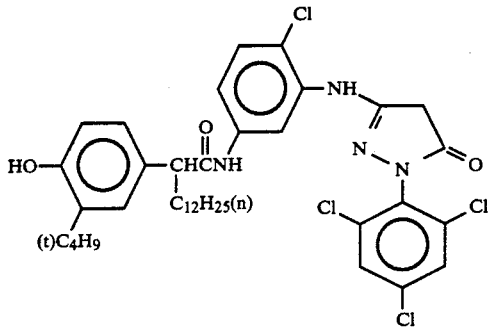
(M-4)
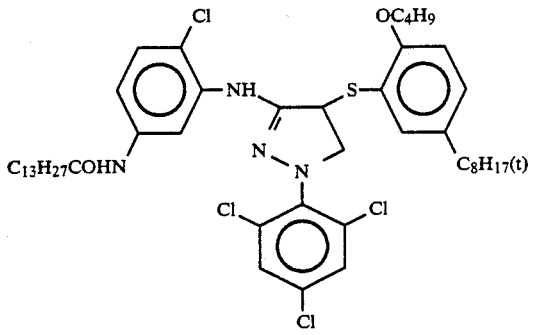
(M-5)
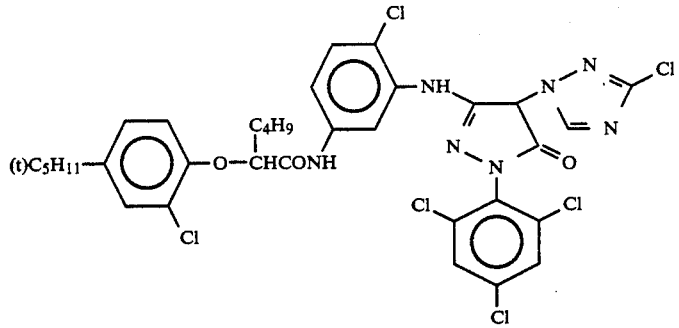
(M-6)
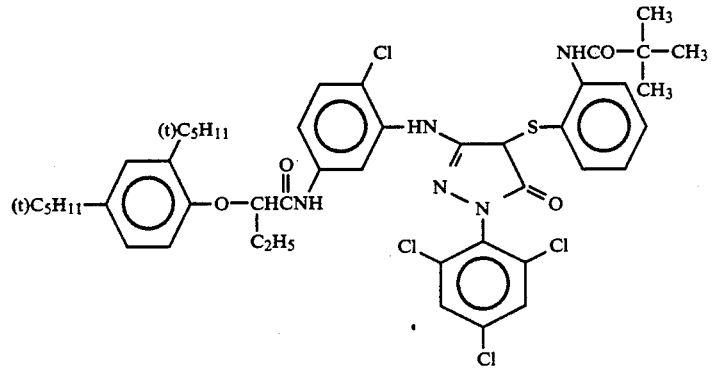

-continued
(M-7)
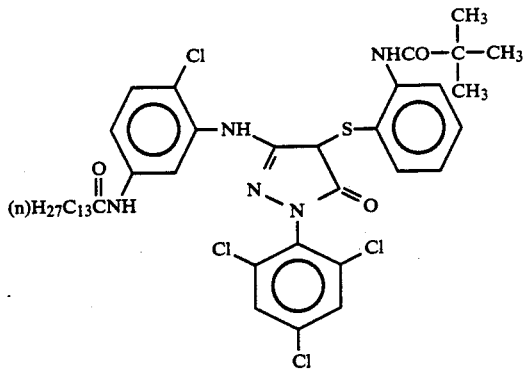
(M-8)
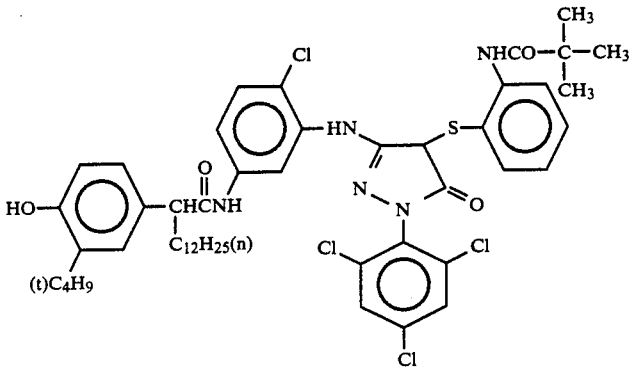
| Compound | $R_{10}$ | $R_{15}$ | $Y_4$ |
|---|---|---|---|
| | | 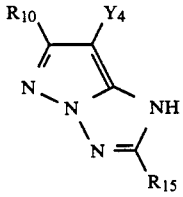 | |
| M-9 | $CH_3$— | 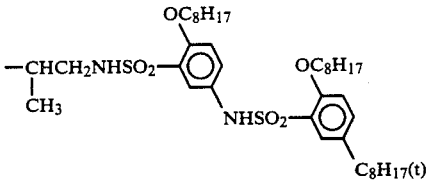 | Cl |
| M-10 | " | 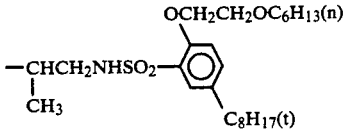 | " |
| M-11 | $(CH_3)_3C$— | 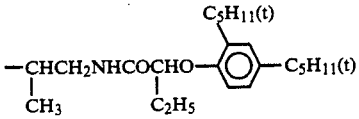 | 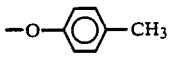 |
| M-12 | 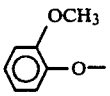 | 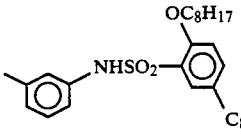 | 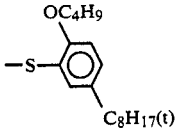 |

-continued
| Compound | $R_{10}$ | $R_{15}$ | $Y_4$ |
|---|---|---|---|
| M-13 | $CH_3$— | 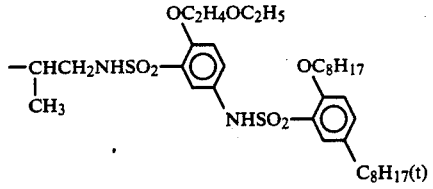 | Cl |
| M-14 | " | 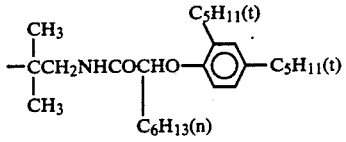 | " |
| M-15 | " | 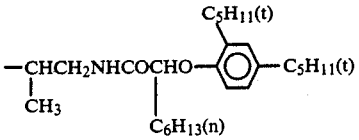 | " |
| M-16 | $CH_3$— | 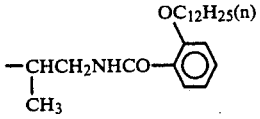 | Cl |
| M-17 | " | 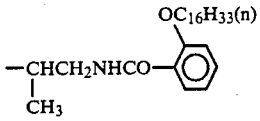 | " |
| M-18 | 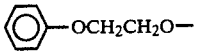 | 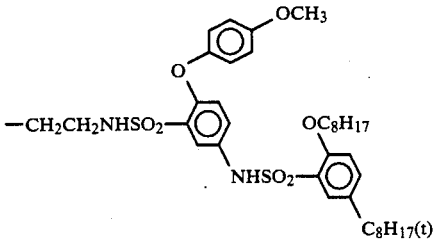 | 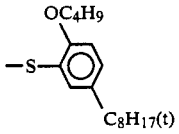 |
| M-19 | $CH_3CH_2O$— | " | " |
| M-20 | 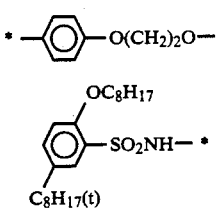 | 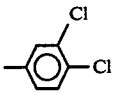 | 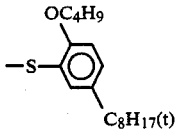 |
| M-21 | 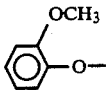 | 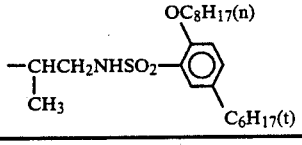 | Cl |
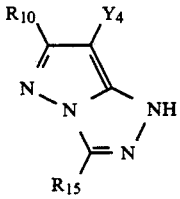

-continued
| Compound | $R_{10}$ | $R_{15}$ | $Y_4$ |
|---|---|---|---|
| M-22 | $CH_3-$ | 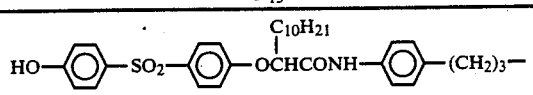 | Cl |
| M-23 | " | 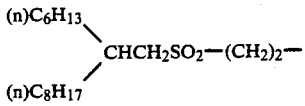 | " |
| M-24 | 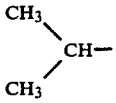 | 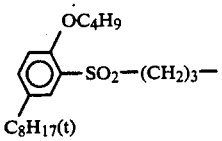 | " |
| M-25 | 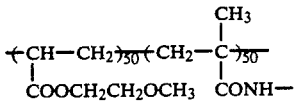 | 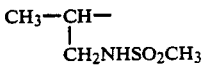 | " |
| M-26 | 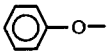 | 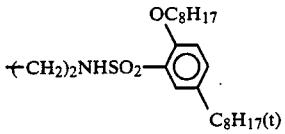 | Cl |
| M-27 | $CH_3-$ | 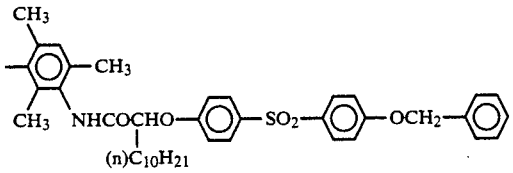 | " |
| M-28 | $(CH_3)_3C-$ | 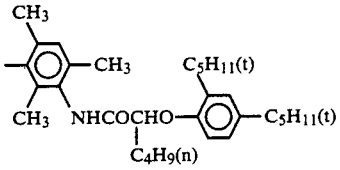 | " |
| M-29 | 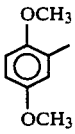 | 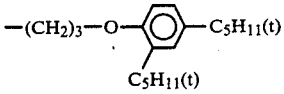 | Cl |
| M-30 | $CH_3-$ | 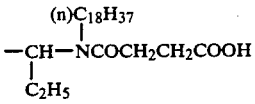 | " |
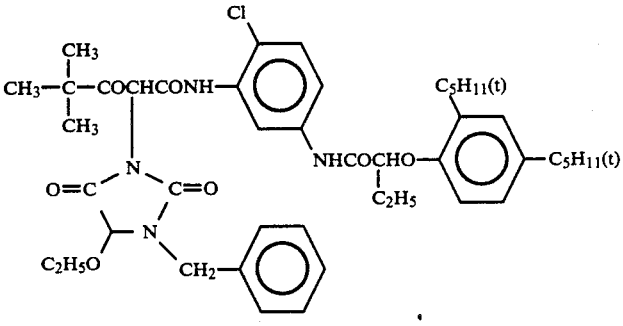
(Y-1)

-continued
(Y-2)
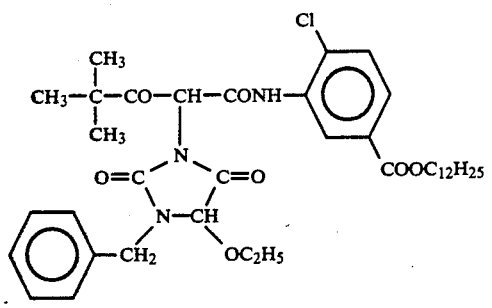
(Y-3)
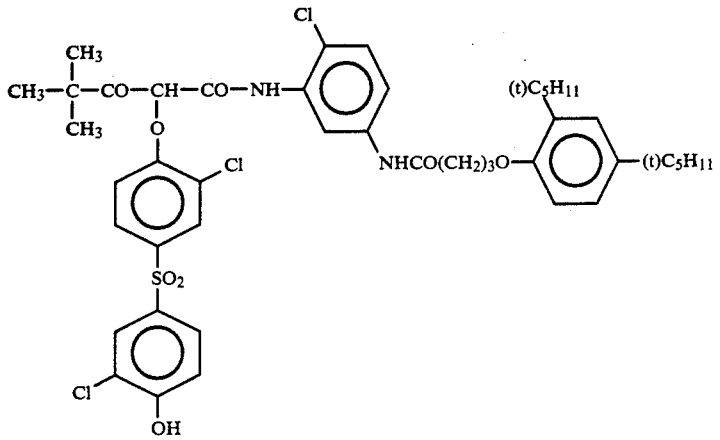
(Y-4)
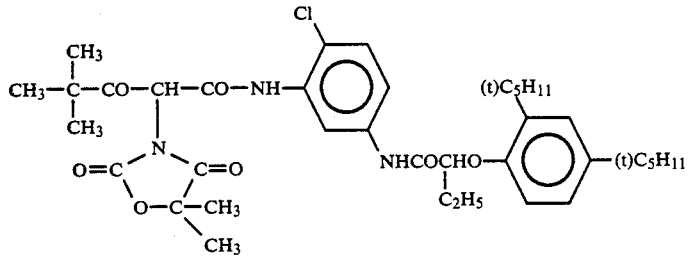
(Y-5)
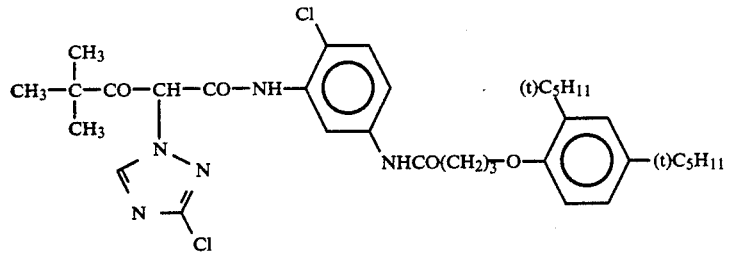
(Y-6)
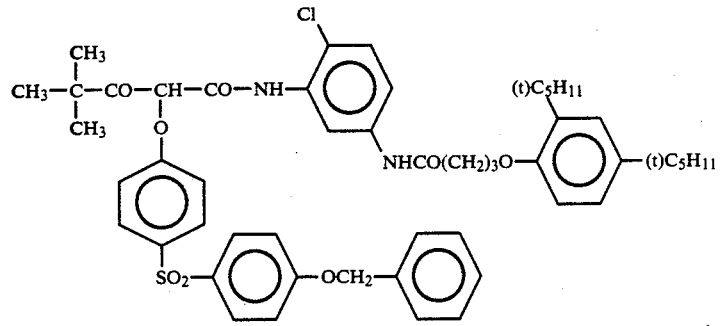

-continued (Y-7)

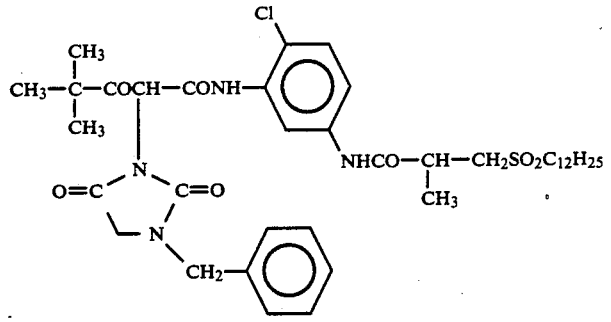

(Y-8)

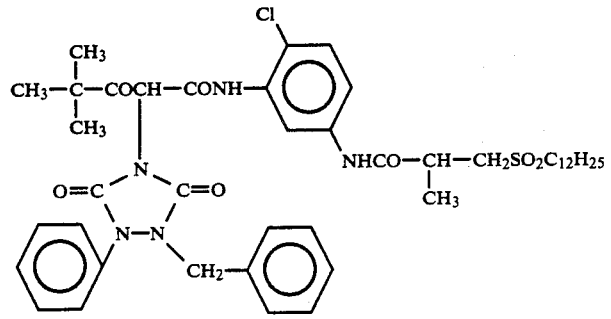

The photographic materials of the present invention may contain color antifoggants such as hydroquinone derivatives, aminophenol derivatives, gallic acid derivatives and ascorbic acid derivatives.

The photographic materials of the present invention may also contain various antifading agents. Namely, typical examples of organic antifading agents for cyan, magenta and/or yellow images include hindered phenols such as hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylating or alkylating phenolic hydroxyl groups of these compounds. Further, metal complexes represented by (bissalicylaldoximato)-nickel complexes and (bis-N,N-dialkyldithiocarbamato)-nickel complexes can also be used.

Specific examples of the organic antifading agents are described in the following patents.

The hydroquinones are described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028, and British Patent 1,363,921. The 6-hydroxychromans, the spirochromans and the 5-hydroxycoumarans are described in U.S. Pat. Nos. 3,432,300, 3,573,050, 3,574,627, 3,698,909 and 3,764,337, and JP-A-52-152225. The spiroindanes are described in U.S. Pat. No. 4,360,589. The p-alkoxyphenols are described in U.S. Pat. No. 2,735,765, British Patent 2,066,975, JP-A-59-10539 and JP-B-57-19765 (the term "JP-B" as used herein refers to an "examined Japanese patent publication"). The hindered phenols are described in U.S. Pat. Nos. 3,700,455 and 4,228,235, JP-A-52-72224 and JP-B-52-6623. The gallic acid derivatives, the methylenedioxybenzenes and the aminophenols are each described in U.S. Pat. Nos. 3,457,079 and 4,332,886 and JP-B-56-21144. The hindered amines are described in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344. The metal complexes are described in U.S. Pat. Nos. 4,050,938 and 4,241,155 and British Patent 2,027,731(A).

Each of these compounds is usually emulsified together with each corresponding color coupler in an amount of 5 to 100% by weight based on the weight of the coupler and the resulting emulsion is added to the light-sensitive emulsion layer. In order to prevent cyan dye images from deterioration due to heat and particularly light, it is more effective to introduce an ultraviolet absorber in a cyan color forming layer and layers on both sides adjacent thereto.

As ultraviolet absorbers, there can be used benzotriazole compounds substituted by aryl groups (for example, the compounds described in U.S. Pat. No. 3,533,794), 4-thiazolidone compounds (for example, the compounds described in U.S. Pat. Nos. 3,314,794 and 3,352,581), benzophenone compounds (for example, the compounds described in JP-A-46-2784), cinnamate compounds (for example, the compounds described in U.S. Pat. Nos. 3,705,805 and 3,707,395), butadiene compounds (for example, the compounds described in U.S. Pat. No. 4,045,229) and benzoxidol compounds (for example, the compounds described in U.S. Pat. Nos. 3,406,070, 3,677,672 and 4,271,307). Ultraviolet absorptive couplers (for example, α-naphthol cyan dye forming couplers) and ultraviolet absorptive polymers may also be used. These ultraviolet absorbers may also be mordanted to a specific layer.

In particular, the above-described benzotriazole compounds substituted by aryl groups are preferably used.

It is further preferred to use the following compounds in combination with the above-described couplers, particularly with the pyrazoloazole couplers.

Namely, from the viewpoint of prevention of, for example, stain generation or other side effects caused by the formation of a color forming dye by reaction of a residual color forming developing agent or its oxidation product with the coupler during storage after processing, it is preferred to use simultaneously or separately a compound (F) which chemically combines with the aromatic amine developing agent remaining after color developing processing to form a compound which is chemically inactive and substantially colorless, and/or a compound (G) which chemically combines with the oxidation product of the aromatic amine developing agent to form a compound which is chemically inactive and substantially colorless.

Preferred examples of compound (F) include compounds which react with p-anisidine at a second order reaction rate constant $k_2$ (in trioctyl phosphate at 80° C.) of from 1.0 to $1\times10^{-5}$ liter/mol·sec. The second order reaction rate constant k can be measured by the method described in JP-A-63-158545.

If the constant $k_2$ is higher than $1\times10^{-5}$ liter/mol·sec, the compounds (F) themselves become unstable, and react with gelatin or water to decompose in some cases. On the other hand, if the constant $k_2$ is lower than 1.0 liter/mol·sec, the reaction of the compounds (F) with the residual aromatic amine developing agent is sometimes too slow to prevent the side effects of the residual aromatic amine developing agent.

More preferred examples of such compounds (F) can be represented by the following general formula (FI) or (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group or a heterocyclic group; n represents 1 or 0; A represents a group which reacts with an aromatic amine developing agent to form a chemical bond; X represents a group which is eliminated by the reaction with an aromatic amine developing agent; B represents a hydrogen atom, an aliphatic group, an aromatic group, a heterocyclic group, an acyl group or a sulfonyl group; Y represents a group which promotes the addition of an aromatic amine developing agent to the compound represented by general formula (FII); and $R_1$ and X, or Y and $R_2$ or B may combine together to form a cyclic structure.

Typical reactions by which these compounds are chemically combined with the aromatic amine developing agents are a substitution reaction and an addition reaction.

Specific examples of the compounds represented by general formula (FI) or (FII), which are preferably used, are described in JP-A-63-158545, JP-A-62-283338, European Patents 298321 and 277589.

In the meantime, more preferred examples of the compounds (G) which chemically combine with the oxidation products of the aromatic amine developing agents to form the compounds which are chemically inactive and substantially colorless can be represented by the following general formula (GI):

$$R-Z \quad \text{(GI)}$$

wherein R represents an aliphatic group, an aromatic group or a heterocyclic group; and Z represents a nucleophilic group or a group which decomposes in a photographic material to release a nucleophilic group. In the compounds represented by general formula (GI), it is preferred that Z is a group which is 5 or more in Pearson's nucleophilic $^{n}$CH3I value (R. G. Pearson et al., *J. Am. Chem. Soc.* 90, 319 (1968)), or a group derived therefrom.

Specific examples of the compounds represented by general formula (GI), which are preferably used, are described in European Patents 255722, 298321 and 277589, JP-A-62-143048, JP-A-62-229145 and JP-A-01-230039.

The details of combinations of the above-described compounds (G) and compounds (F) are described in European Patent 277589.

In the photographic materials of the present invention, the hydrophilic colloid layers may contain water-soluble dyes or dyes which become water-soluble by photographic processing, as filter dyes, for the purpose of preventing irradiation or halation and for other various purposes. Such dyes include oxonol dyes, hemioxonol dyes, styryl dyes, merocyanine dyes, cyanine dyes and azo dyes. In particular, the oxonol dyes, the hemioxonol dyes and the merocyanine dyes are useful.

Gelatin can be advantageously used as a binder or a protective colloid for emulsion layers of the photographic material of the present invention. However, hydrophilic colloids other than gelatin may be used separately or in combination with gelatin.

Gelatin used in the present invention may be either treated with lime or treated with an acid. The details of the methods for preparing gelatin are described in Arthur Vice, *The Macromolecular Chemistry of Gelatin* (Academic Press, 1964).

In the present invention, a transparent film such as a cellulose nitrate film or a polyethylene terephthalate film, or a reflecting support, which is usually used for photographic materials, can be used as the support. For the purpose of the present invention, it is more preferable to use the reflecting support.

The "reflecting support" used in the present invention means a support whose reflectivity is increased to clarify dye images formed on silver halide emulsion layers. Such supports include supports coated with hydrophobic resins containing light reflective materials such as titanium dioxide, zinc oxide, calcium carbonate and calcium sulfate dispersed therein, and supports formed of hydrophobic resins containing light reflective materials dispersed therein. Examples thereof include paper such as baryta paper, polyethylene-coated paper and polypropylene synthetic paper, provided with reflective layers or containing reflective materials, and transparent supports such as glass plates, cellulose films such as a cellulose triacetate film and a cellulose nitrate film, polyester films such as a polyethylene terephthalate film, polyamide films, polycarbonate films, a polystyrene films and a vinyl chloride resin.

As another reflecting support, a support having a metal surface of mirror reflection or second kind diffusion reflection properties can be used. It is preferred that the metal surface is at least 0.5 in spectral reflectivity in a visible wavelength range and is roughened or converted to the surface of diffused reflection by using a metal powder. As the metals, there are used aluminum, tin, silver, magnesium, their alloys and the like. The metal surface may be formed of a metal plate, metal foil or a thin metal layer, which is obtained by rolling, evaporation or metal plating. In particular, evaporation of a metal onto a different substrate is preferable. It is preferred that a hydrophobic resin, particularly a thermoplastic resin, is provided on the metal surface. The support used in the present invention is preferably provided with an antistatic layer on the surface opposite to the metal surface. The details of such a support are described in, for example, JP-A-61-210346, JP-A-63-24247, JP-A-63-24251 and JP-A-63-24255.

These supports can be suitably selected depending on their purposes.

The light reflective materials are preferably obtained by mixing white pigments sufficiently in the presence of surfactants. It is preferred to use the light reflective materials in which the surface of pigment grains are treated with dihydric to tetrahydric alcohols.

Most typically, the occupied area ratio (%) of fine grains of a white pigment per specified unit area can be determined by dividing an observed area into 6 $\mu m \times 6$ $\mu m$ unit areas adjacent to one another and measuring the occupied area ratio (%) ($R_i$) of the fine grains projected to the unit areas. The coefficient of variation of the occupied area ratio (%) can be determined by the ratio $s/\overline{R}$ of the standard deviation s of $R_i$ to the mean value $\overline{R}$ of $R_i$. It is preferred that the number (n) of the unit areas to be measured is 6 or more. The coefficient of variation $s/\overline{R}$ can therefore be determined by the following formula:

$$\frac{\sqrt{\dfrac{\sum_{i=1}^{n}(R_i-\overline{R})^2}{n-1}}}{\dfrac{\sum_{i=1}^{n}R_i}{n}}$$

In the present invention, it is preferred that the coefficient of variation of the occupied area ratio (%) is 0.15 or less, particularly 0.12 or less. When the coefficient is 0.08 or less, the dispersibility of the grains can be said to be substantially "homogeneous".

The color developing solutions used for development of the photographic materials of the present invention are preferably aqueous alkaline solutions mainly containing the aromatic primary amine color developing agents. Although aminophenol compounds are useful as the color developing agents, p-phenylenediamine compounds are preferably used. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides and p-toluenesulfonates thereof. Two or more kinds of these compounds can also be used in combination with one another depending on the purposes.

The color developing solutions generally contain pH buffers such as alkali metal carbonates and phosphates, and development inhibitors or antifoggants such as bromides, iodides, benzimidazoles, benzothiazoles and mercapto compounds. Further, the color developing solutions may contain hydrazines such as hydroxylamine, diethylhydroxylamine, sulfites, and N,N-biscarboxymethylhydrazine, various preservatives such as phenylsemicarbazides, triethanolamine, and catechol sulfonic acids, organic solvents such as ethylene glycol and diethylene glycol, development accelerators such as benzyl alcohol, polyethylene glycol, quaternary ammonium salts and amines, auxiliary developing agents such as dye forming couplers, competitive couplers and 1-phenyl-3- pyrazolidone, viscosity imparting agents (tackifiers) and various chelating agents represented by aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid) and salts thereof.

Generally, when reversal processing is conducted, black-and-white development and reversal development are first carried out, and then color development is performed. Black-and-white developing solutions may contain known black-and-white developing agents, such as dihydroxybenzenes (for example, hydroquinone), 3-pyrazolidones (for example, 1-phenyl-3-pyrazolidone) and aminophenols (for example, N-methyl-p-aminophenol). These developing agents may be used separately or in combination. These color developing solutions and black-and-white developing solutions are generally 9 to 12 in pH. The replenishment rate of these developing solutions varies depending on the type of color photographic material to be treated, but is usually not more than 3 liters per square meter of photographic material. By reducing the ion concentration of the bromide in the replenisher, the replenishment rate can also be decreased to 500 ml/m$^2$ or less. When the replenishment rate is decreased, it is preferred to reduce the contact area of the processing solution with air to prevent the solution from evaporation and air oxidation. The contact area of the photographic processing solution with air in a processing tank can be represented by the opening ratio defined below.

Opening Ratio = Contact Area of Processing Solution with Air (cm$^2$)/Volume of Processing Solution (cm$^3$)

the opening ratio is preferably 0.1 or less, more preferably 0.001 to 0.05.

Method for reducing the opening ratio like this include the method using a movable cover as described in JP-A-01-82033 and the slit developing method described in JP-A-63-216050, in addition to a method in which a shield such as a floating cover is provided on the surface of the photographic processing solution in the processing tank. The reduction of the opening ratio is preferably applied not only to both stages of color development and black-and-white development, but also to succeeding stages, for example, all stages of bleaching, bleaching-fixing treatment, fixing, washing, stabilizing and the like.

The replenishment rate can also be decreased by depressing accumulation of the bromide ions in the developing solution.

The time of the color development processing is usually established between 2 minutes and 5 minutes. However, the elevated temperature, the higher pH and the use of the color developing solution high in concentration can further reduce the processing time.

After color development, the photographic emulsion layer is generally bleached. Bleaching may be carried out simultaneously with fixing (bleaching-fixing treatment) or separately. The bleaching-fixing treatment may be conducted after bleaching to expedite processing. A treatment with a bleaching-fixing bath composed of two consecutive tanks, fixing prior to the bleaching-fixing treatment, or bleaching after the bleaching-fixing treatment may be arbitrarily carried out depending on the purpose.

As bleaching agents, for example, compounds of polyvalent metals such as iron(III) are used. Typical examples of the bleaching agents include organic complexes of iron(III), for example, complex salts of iron(III) with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol, ether diaminetetraacetic acid, and complex salts of iron(III) with citric acid, tartaric acid, and malic acid. Of these, the complex salts of iron(III) with aminopolycarboxylic acids including the complex salt of iron(III) with ethylenediaminetetraacetic acid are preferable from the viewpoint of rapid processing and prevention of environmental pollution. Further, the complex salts of iron(III) with aminopolycarboxylic acids are also particularly useful for both bleaching solution and bleaching-fixing solutions. The pH of the bleaching solutions or the bleaching-fixing solutions using these complex salts of iron(III) with aminopolycarboxylic acids is usually 4.0 to 8.0. However, the pH can also be lowered to expedite processing.

Bleaching promoters may be added to the bleaching solutions, the bleaching-fixing solutions and the preceding baths thereof, as required. Specific examples of the useful bleaching promoters include the compounds having mercapto groups or disulfide linkages described in U.S. Pat. No. 3,893,858, West German Patent 1,290,812, JP-A-53-95630 and *Research Disclosure*, No. 17129 (July, 1978), the thiazolidine derivatives described in JP-A-50-140129, the thiourea derivatives described in U.S. Pat. No. 3,706,561, iodides described in JP-A-58-16235; the polyoxyethylene compounds described in West German Patent 2,748,430, the polyamine compounds described in JP-B-45-8836, and bromide ions. In particular, the compounds having mercapto groups or disulfide linkages are preferable from the viewpoint of high promoting effect, and particularly the compounds described in U.S. Pat. No. 3,893,858, West German Patent 1,290,812 and JP-A-53-95630 are preferable. In addition, the compounds described in U.S. Pat. No. 4,552,834 are also preferable. These bleaching promoters may be added to the photographic materials. When the bleaching-fixing treatment of color photographic materials for shooting is carried out, these bleaching promoters are particularly effective.

Fixing agents include thiosulfates, thiocyanates, thioether compounds, thioureas, and large quantities of iodides. The thiosulfates are generally used, and particularly ammonium thiosulfate can be most widely used. As preservatives for the bleaching-fixing solutions, there can be advantageously used sulfites, bisulfites, sulfinic acids such as p-toluenesulfinic acid, or carbonyl bisulfite addition compounds.

The silver halide color photographic materials of the present invention are usually subjected to washing and/or a stabilization stage after desilverization. The amount of rinsing water used in the washing stage can be widely established depending on the characteristics of the photographic materials (for example, depending on materials used such as couplers), the use, the temperature of the rinsing water, the number of rinsing tanks (the number of stages), the replenishing system (countercurrent or direct flow) and other various conditions. Of these, the relationship between the amount of the rinsing water and the number of the rinsing tanks in the multistage countercurrent system can be determined by the method described in *Journal of the Society of Motion Picture and Television Engineers*, 64, 248–253 (May, 1955).

According to the multistage countercurrent system described in the above literature, the amount of the rinsing water can be substantially reduced. However, the increased residence time of the rinsing water in the tanks produces the problem that bacterium propagate in the water and the resulting suspended matter adheres on the photographic materials. In order to solve such a problem in the processing of the color photographic materials of the present invention, the method for reducing calcium ions and magnesium ions described in JP-A-62-288838 is very effectively used. There are also used the thiazolone compounds and the thiapentazoles described in JP-A-57-8542; chlorine disinfectants such as chlorinated sodium isocyanurate; benzotriazole; and the disinfectants described in Hiroshi Horiguchi, *Chemistry of Bacteria prevention and Fungus Prevention*, Sankyo Shuppan (1986), *Sterilization, Pasteurization and Fungus Prevention Techniques of Microorganisms*, edited by Eisei Gijutsukai, Kogyo Gijutsukai (1982) and *Dictionary of Disinfectants and Fungicides*, edited by Nippon Bohkin Bohbai Gakkai (1986).

The pH of the rinsing water used in the processing of the photographic materials of the present invention is 4 to 9, preferably 5 to 8. The temperature of the rinsing water and washing time can also be variously established depending on the characteristics of the photographic materials, the use thereof, and the like. In general, however, a temperature of 15° to 45° C., preferably 25° to 40° C., and a time of 20 seconds to 10 minutes, preferably 30 seconds to 5 minutes, are selected. The photographic materials of the present invention can also be treated directly with stabilizing solutions in place of the above-described washing. In such stabilizing processing, all of the known methods described in JP-A-57-8543, JP-A-58-14834 and JP-A-60-220345 can be used.

In some cases, following on the above-described washing processing, stabilization processing is further carried out. Examples thereof include a stabilizing bath which is used as a final bath for the color photographic materials for shooting and contains formalin and a surfactant. Various chelating agents and fungicides may be added to this stabilizing bath.

Overflowed solutions derived from the above-described washing and/or replenishment of the stabilizing solutions can be reclaimed in other stages such as the desilverizing stage.

The silver halide color photographic materials of the present invention may contain the color developing agents in order to simplify and expedite processing. It is preferred that various precursors of the color developing agents are added to the photographic materials. Examples of such precursors include the indoaniline compounds described in U.S. Pat. No. 3,342,597, the Schiff base type compounds described in U.S. Pat. No. 3,342,599, *Research Disclosure*, No. 14850 and *ibid.*, No. 15159, the aldol compounds described in *Research Disclosure*, No. 13924, the metal complexes described in U.S. Pat. No. 3,719,492, and the urethane compounds described in JP-A-53-135628.

The silver halide color photographic materials of the present invention may contain various 1-phenyl-3pyrazolidones for the purpose of promoting color development, as required. Typical compounds thereof are described in JP-A-56-64339, JP-A-57-144547 and JP-A-58-115438.

Various processing solutions for treating the photographic materials of the present invention are used at a temperature of 10° C. to 50° C. The standard temperature is usually 33° C. to 38° C. The temperature may be elevated higher to expedite processing, whereby the processing time can be shortened. On the contrary, the temperature can be decreased lower to achieve improvements in image qualities and in stability of the processing solutions. In addition, processing may be conducted using cobalt intensification or hydrogen peroxide intensification described in West German Patent 2,226,770 or U.S. Pat. No. 3,674,499 to save silver of the photographic materials.

The present invention will be further illustrated in greater detail with reference to the following examples, which are, however, not to be construed as limiting the invention.

EXAMPLE 1

A paper support both sides of which were laminated with polyethylene was coated with the following layers to prepare sheet of multilayer color photographic paper 101. Coating solutions were prepared as follows.

Preparation of Coating Solution for Fifth Layer 55.0 cc of ethyl acetate was added to 40.0 g of hydrophobic polymer (P-2) having a mean molecular weight of 60,000, 15.0 g of coupler solvent (Solv-6) and 4.0 g of color image stabilizer (Cpd-8), followed by heating at 60° C. to mix them. The resulting solution was emulsified and dispersed in 120 cc of 20% gelatin solution containing 54 cc of 10% sodium dodecylbenzenesulfonate to prepare a hydrophobic polymer latex having a mean grain size of 0.08 μm. On the other hand, 40.0 cc of ethyl acetate was added to 32.0 g of cyan coupler (ExC) and 17.0 g of color image stabilizer (Cpd-6) to dissolve them. Then, the above-described hydrophobic polymer latex was added thereto while stirring with a homogenizer. To the resulting water-in-oil emulsion was added 400 cc of 20% aqueous solution of gelatin, followed by stirring with a homogenizer, thereby providing an oil-in-water emulsion in which the cyan coupler having a mean grain size of 0.13 μm was impregnated with the hydrophobic polymer latex.

In the meantime, the following red-sensitizing dye was added, in an amount of $0.9\times10^{-4}$ mol per mol of silver for a large-sized emulsion, and in an amount of $1.1\times10^{-4}$ mol per mol of silver for a small-sized emulsion, to a silver chlorobromide emulsion (cubic, a 1:4 mixture (Ag mol ratio) of an emulsion 0.58 μm in mean grain size and an emulsion 0.45 μm in mean grain size, coefficients of variation in grain size distribution for the respective emulsions being 0.09 and 0.11, each emulsion containing 0.6 mol% of AgBr localized on a part of the surface of grains), and further the following additives were added to prepare a sulfur sensitized emulsion. The above-described emulsified dispersion and this emulsion were mixed with each other to prepare a coating solution for a red-sensitive layer so as to have the following composition.

Coating solutions for blue- and green-sensitive layers were similarly prepared by dissolving the respective photographic materials described below in ethyl acetate, emulsifying and dispersing the resulting solution in a gelatin solution containing sodium dodecylbenzenesulfonate, and mixing the emulsified material with the silver halide emulsion for the respective layer.

As a gelatin hardener for each layer, the sodium salt of 1-oxy-3,5-dichloro-s-triazine was used.

As color sensitizing dyes for the respective layers, the following dyes were used.

Dyes for Blue-Sensitive Emulsion Layer

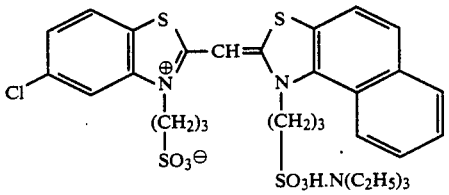

and

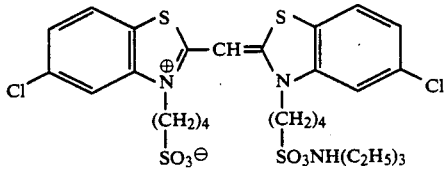

($2.0\times10^{-4}$ mol per mol of silver halide, respectively, for a large-sized emulsion, and $2.5\times10^{-4}$ mol per silver halide, respectively, for a small-sized emulsion)

Dyes for Green-Sensitive Emulsion Layer

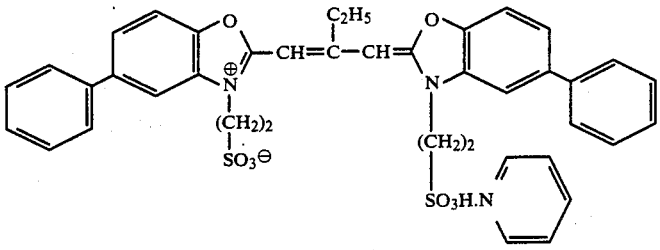

($4.0\times10^{-4}$ mol per mol of silver halide, for a large-sized emulsion, and $5.6\times10^{-4}$ mol per silver halide, for a small-sized emulsion), and

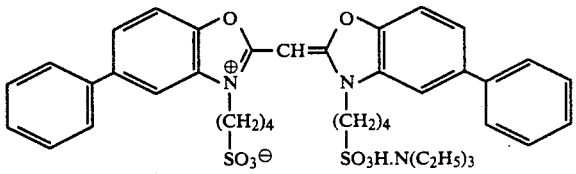

($7.0\times10^{31\ 5}$ mol per mol of silver halide, for a large-sized emulsion, and $1.0\times10^{-5}$ mol per silver halide, for a small-sized emulsion)

Dye for Red-Sensitive Emulsion Layer

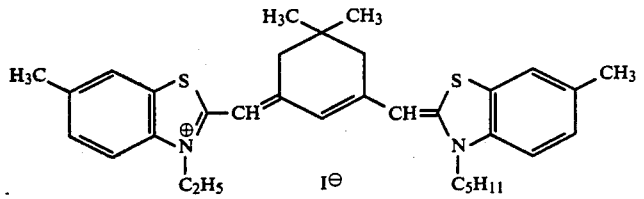

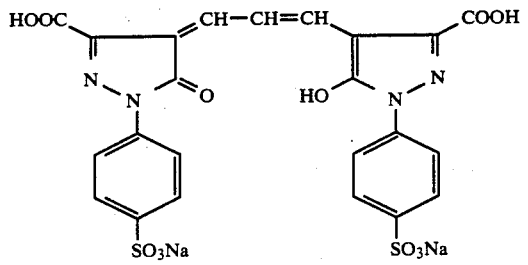

and

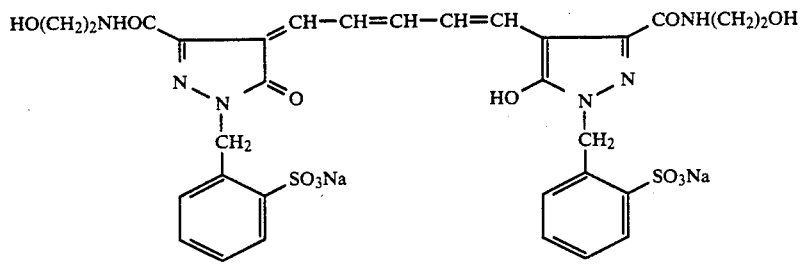

($0.9\times10^{-4}$ mol per mol of silver halide, for a large-sized emulsion, and $1.1\times10^{-4}$ mol per silver halide, for a small-sized emulsion)

To the red-sensitive emulsion layer was added the following compound in an amount of $2.6\times10^{-3}$ mol per mol of silver halide:

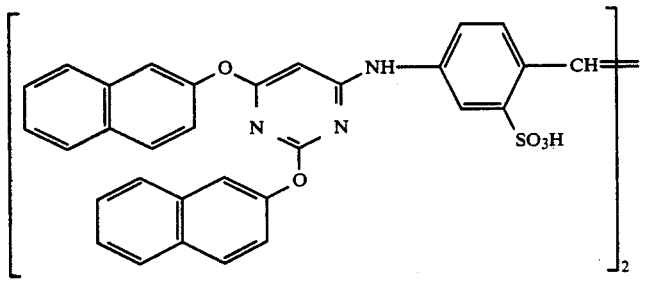

Further, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol per mol of silver halide, respectively.

Furthermore, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{4}$ mol per mol of silver halide, respectively.

The following dyes were added in amounts of 5 mg/m$^2$ and 15 mg/m$^2$, respectively, to each emulsion layers for prevention of irradiation:

Layer Constitution

The composition of each layer in a sample referred to herein Sample 101 is hereinafter shown. Numerals indicate coated weights (g/m$^2$). For the silver halide emulsions, numerals indicate coated weights converted to silver.

Support

Paper laminated with polyethylene (polyethylene on the side of the first layer containing a white pigment ($TiO_2$) and a bluing dye (ultramarine))

First Layer (Blue-Sensitive Layer)

| | |
|---|---|
| Silver Chlorobromide Emulsion Described Above | 0.30 |

-continued

| | |
|---|---|
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Layer) | |
| Silver Chlorobromide Emulsion (cubic, a 1:3 mixture (Ag mol ratio) of an emulsion 0.55 μm in mean grain size and an emulsion 0.39 μm in mean grain size, coefficients of variation in grain size distribution for the respective emulsions being 0.10 and 0.08, each emulsion containing 0.8 mol % of AgBr localized on a part of the surface of grains) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Light Absorbing Layer) | |
| Gelatin | 1.58 |
| Ultraviolet Light Absorber (UV-1) | 0.47 |
| Color Mixing Inhibitor (Cpd-5) | 0.05 |
| Solvent (Solv-5) | 0.24 |
| Fifth Layer (Red-Sensitive Layer) | |
| Silver Chlorobromide Emulsion (cubic, a 1:4 mixture (Ag mol ratio) of an emulsion 0.58 μm in mean grain size and an emulsion 0.45 μm in mean grain size, coefficients of variation in grain size distribution for the respective emulsions being 0.09 and 0.11, each emulsion containing 0.6 mol % of AgBr localized on a part of the surface of grains) | 0.23 |
| Gelatin | 1.34 |
| Cyan Coupler (ExC) | 0.32 |
| Color Image Stabilizer (Cpd-6) | 0.17 |
| Hydrophobic Polymer (P-2) | 0.40 |
| Color Image Stabilizer (Cpd-8) | 0.04 |
| Solvent (Solv-6) | 0.15 |
| Sixth Layer (Ultraviolet Light Absorbing Layer) | |
| Gelatin | 0.53 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.33 |
| Acrylic Modified Copolymer of Polyvinyl Alcohol (degree of modification: 17%) | 0.17 |
| Liquid Paraffin | 0.03 |

(ExY) Yellow Coupler

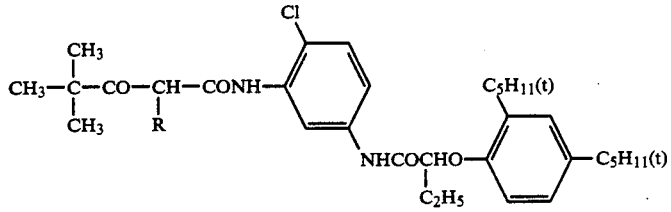

A 1:1 mixture (mol ratio) of

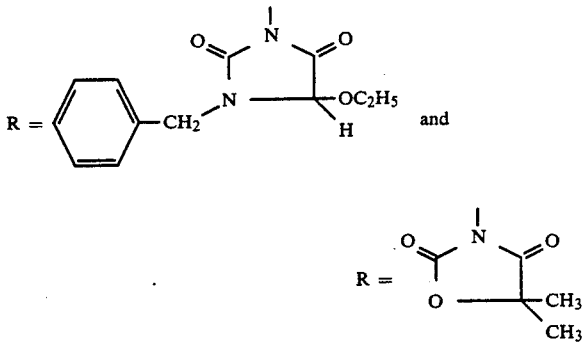

(ExM) Magenta Coupler

A 1:1 mixture (mol ratio) of

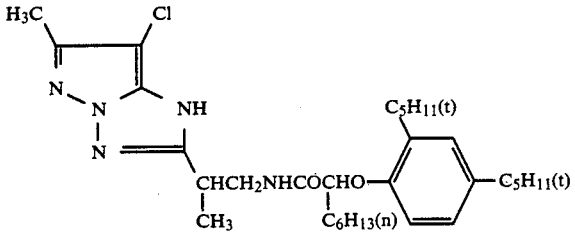

and

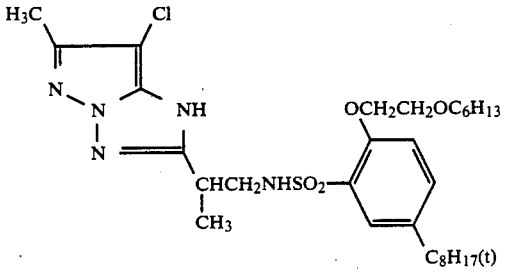

(ExC) Cyan Coupler

A 2:4:4 mixture by weight of

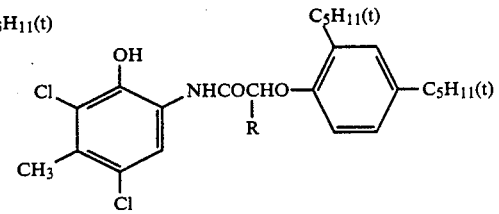

wherein R=$C_2H_5$ and $C_4H_9$ and

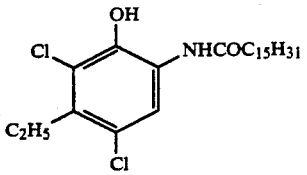
(Cpd-1) Color Image Stabilizer
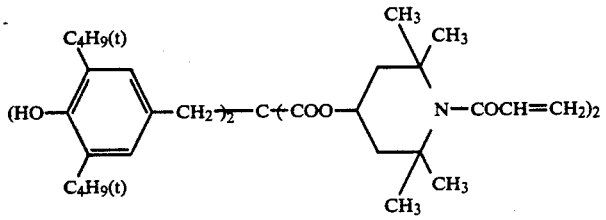
(Cpd-2) Color Image Stabilizer
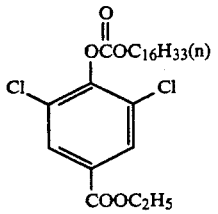
(Cpd-3) Color Image Stabilizer
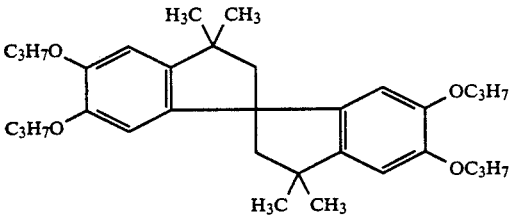
(Cpd-4) Color Image Stabilizer
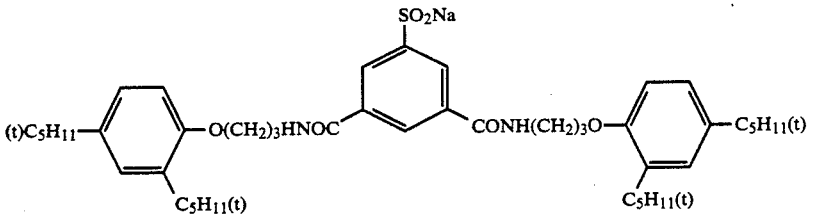
(Cpd-5) Color Mixing Inhibitor
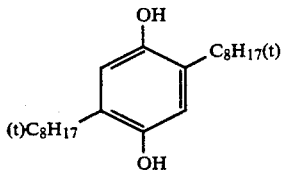
(Cpd-6) Color Image Stabilizer
A 2:4:4 mixture (weight ratio) of
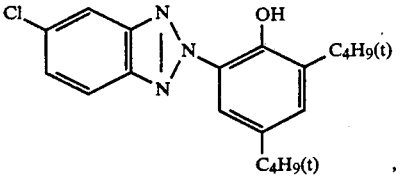
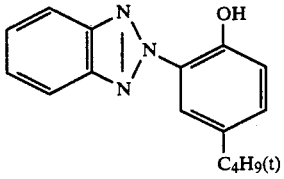
and
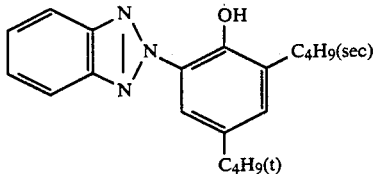
(Cpd-7) Color Image Stabilizer
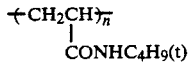
(Cpd-8) Color Image Stabilizer
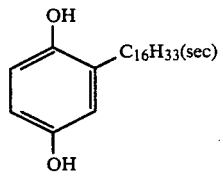

(Cpd-9) Color Image Stabilizer

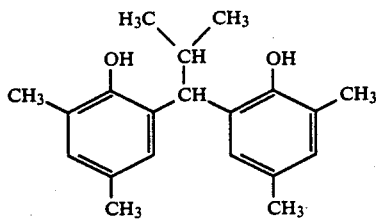

(UV-1) ULtraviolet Light Absorber

A 4:2:4 mixture (weight ratio) of

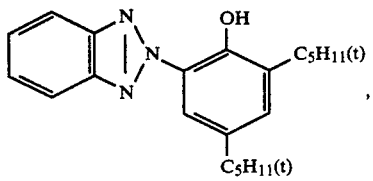

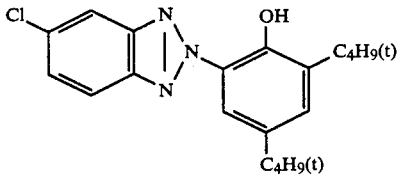

and

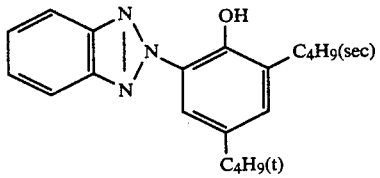

(Solv-1) Solvent

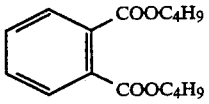

(Solv-2) Solvent

A 2:1 mixture (volume ratio) of

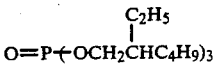

and

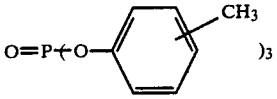

(Solv-4) Solvent

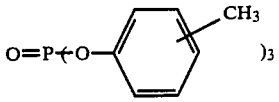

(Solv-5) Solvent

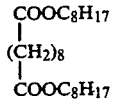

(Solv-6) Solvent

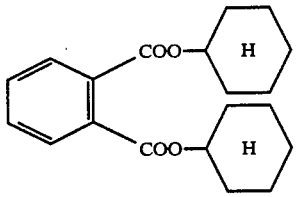

Samples 102 to 106 were prepared in the same manner as with the above Sample 101, except that the hydrophobic polymer of the red-sensitive layer was replaced with the polymers described below, having the same weight as the polymer of Sample 101, respectively.

Each of the samples was subjected to radiation exposure through a three color separating filter for sensitometry by using a sensitometer (Fuji Photo Film Co., Ltd., FWH type, color temperature of light source: 3,200° K.). The exposure at this time was adjusted so as to amount to 250 CMS when the exposure time was 0.1 second.

As to the samples to which the exposure was completed, continuous processing (running test) was carried out according to the following processing stages using a paper processor until the replenishment rate of the processing solutions reached two times the tank capacity of the color development.

| Processing Stage | Temperature (°C.) | Time (sec) | Replenisher* (ml) | Tank Capacity (liter) |
|---|---|---|---|---|
| Color Development | 35 | 45 | 161 | 17 |
| Bleaching-Fixing | 30–35 | 45 | 215 | 17 |
| Rinsing (1) | 30–35 | 20 | — | 10 |
| Rinsing (2) | 30–35 | 20 | — | 10 |
| Rinsing (3) | 30–35 | 20 | 350 | 10 |
| Drying | 70–80 | 60 | | |

*Replenishment rate: ml/m$^2$ of light-sensitive material (Three tank countercurrent system from rinsing (3) to rinsing (1) was employed.)

The composition of each processing solution was as follows.

Color Developing Solution

| | Tank Solution | Replenisher |
|---|---|---|
| Water | 800 ml | 800 ml |

-continued

| | | |
|---|---|---|
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)hydrazine | 5.5 g | 7.0 g |
| Fluorescent Brightener (WHITEX 4B, Sumitomo Chemical Co., Ltd.) | 1.0 g | 2.0 g |
| Water to make | 1,000 ml | 1,000 ml |
| pH (25° C.) | 10.05 | 10.45 |

Bleaching-Fixing Solution (tank solution and replenisher being the same)

| | |
|---|---|
| Water | 400 ml |
| Ammonium Thiosulfate (70%) | 100 ml |
| Sodium Sulfite | 17 g |
| Ethylenediaminetetraacetic Acid Fe(III) Ammonium | 55 g |
| Disodium Ethylenediaminetetraacetate | 5 g |
| Ammonium Bromide | 40 g |
| Water to make | 1,000 ml |
| pH (25° C.) | 5.45 |

Rinsing Solution (tank solution and replenisher being the same)

Ion-Exchanged Water (the content of each of calcium and magnesium being not more than 3 ppm)

The cyan density of the samples thus obtained was measured with a Fuji densitometer (MAD-8509 type). In order to evaluate the light fastness of these samples, the samples were irradiated with a xenon tester (about 150,000 luxes) for a day, or with a fluorescent lamp tester (about 17,000 luxes) for 10 days, and then the cyan density of each sample was measured. The amount of density decrease from an initial density of 2.5 is shown in Table 1.

TABLE 1

| Sample | Kind of Hydrophobic Polymer | Degree of Light Fading (%) Xenon | Fluorescent Lamp | Remark |
|---|---|---|---|---|
| 101 | P-2 | 4.0 | 5.1 | Invention |
| 102 | P-4 | 4.2 | 5.2 | Invention |
| 103 | P-11 | 4.0 | 5.1 | Invention |
| 104 | — | 13.0 | 7.0 | Comparison |
| 105 | Polymer A* for Comparison | 10.7 | 5.8 | Comparison |
| 106 | Polymer B* for Comparison | 10.6 | 5.4 | Comparison |
| 107 | Polymer C* for Comparison | 10.9 | 5.3 | Comparison |
| 108 | Polymer D* for Comparison | 11.2 | 6.1 | Comparison |
| 109 | Polymer E* for Comparison | 10.8 | 5.2 | Comparison |
| 110 | Polymer F* for Comparison | 12.0 | 6.0 | Comparison |
| 111 | Polymer G* for Comparison | 10.4 | 5.4 | Comparison |

TABLE 1-continued

*Polymer A for Comparison: $\leftarrow CH_2CH \rightarrow$ (side chain $COOC_4H_9(n)$)

Polymer B for Comparison: $\leftarrow CH_2CH \rightarrow$ (side chain $OCOCH_3$)

Polymer C for Comparison: $\leftarrow CH_2C \rightarrow$ ($CH_3$; side chain $COOC_6H_{13}(n)$)

Polymer D for Comparison: $\leftarrow CH_2CH \rightarrow$ (side chain 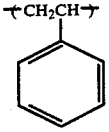 )

Polymer E for Comparison: $\leftarrow COC_4H_8 \rightarrow$

Polymer F for Comparison: $\leftarrow CH_2CHCl \rightarrow$

Polymer G for Comparison: $\leftarrow CH_2CHO \rightarrow$ ($CH_3$)

As apparent from the results shown in Table 1, the samples containing the hydrophobic polymer latexes according to the present invention and the samples containing the hydrophobic polymer latexes other than the polymer latexes used in the present invention were both not so much improved in light fading under low illuminance using the fluorescent lamp, compared to the sample containing no hydrophobic polymer.

In contrast, when the fading test was conducted under high illuminance using the xenon lamp, only the samples containing the hydrophobic polymer latexes according to the present invention were reduced in degree of light fading to less than ½ that of the other samples.

Thus, it is shown that the hydrophobic polymer latexes according to the present invention had a specific improving effect to the light fading of cyan dyes under high illuminance.

EXAMPLE 2

Samples 201 to 206 were prepared in the same manner as with Sample 101 of Example 1, except that the hydrophobic polymer of the red-sensitive layer was replaced with the polymers shown in Table 2.

The samples were exposed according to the method described in Example 1. The light fastness of the samples thus obtained was evaluated according to the method described in Example 1. The results are shown in Table 2.

TABLE 2

| Sample | Kind of Hydrophobic Polymer | Relative Fluorescent Quantum Yield (K Value) | Degree of Light Fading Xenon (%) | Remark |
|---|---|---|---|---|
| 201 | P-14 | 1.26 | 3.9 | Invention |
| 202 | P-3 | 1.10 | 4.1 | Invention |
| 203 | P-13 | 0.25 | 4.3 | Invention |
| 204 | P-1 | 0.18 | 5.9 | Invention |
| 205 | Polymer A* for Comparison | 0.17 | 10.0 | Comparison |
| 206 | Polymer C* for Compari- | 0.17 | 11.0 | Comparison |

TABLE 2-continued

| Sample | Kind of Hydrophobic Polymer | Relative Fluorescent Quantum Yield (K Value) | Degree of Light Fading Xenon (%) | Remark |
|---|---|---|---|---|
| | son | | | |

*Polymers A and C for Comparison are the same as with Example 1.

As apparent from the results shown in Table 2, the light fading under high illuminance was improved by using the hydrophobic polymers according to the present invention. It can also be seen that the higher relative fluorescent quantum yield (K value) the hydrophobic polymers had, the more effect they had. In particular, the polymers having a K value of 0.2 or more gave a remarkable effect.

EXAMPLE 3

A paper support both sides of which were laminated with polyethylene was coated with the following layers to prepare a sheet of multilayer color photographic paper 301. Coating solutions were prepared as follows.

Preparation of Coating Solution for Fifth Layer 55.0 cc of ethyl acetate was added to 40.0 g of hydrophobic polymer (P-2) having a mean molecular weight of 60,000, 20.0 g of coupler solvent (Solv-6) and 4.0 g of color image stabilizer (Cpd-10) to dissolve them. The resulting solution was emulsified and dispersed in 120 cc of 20% gelatin solution containing 54 cc of 10% sodium dodecylbenzenesulfonate to prepare a hydrophobic polymer latex having a mean grain size of 0.08 μm. This hydrophobic polymer latex solution is hereinafter referred to as Solution I. On the other hand, 40.0 cc of ethyl acetate was added to 30.0 g of cyan coupler (ExC) and 17.0 g of color image stabilizer (Cpd-6) to dissolve them. This cyan coupler solution is hereinafter referred to as Solution II. Then, the above-described hydrophobic polymer latex (Solution I) was added thereto while stirring with a homogenizer. To the resulting water-in-oil emulsion was added 400 cc of 20% aqueous solution of gelatin, followed by stirring with a homogenizer, thereby providing an oil-in-water emulsion in which the cyan coupler having a mean grain size of 0.13 μm was impregnated with the hydrophobic polymer latex.

In the meantime, the following red-sensitizing dye was added, in an amount of $0.9\times10^{-4}$ mol per mol of silver for a large-sized emulsion, and in an amount of $1\times10^{-4}$ mol per mol of silver for a small-sized emulsion, to a silver chlorobromide emulsion (a 1:2 mixture (Ag mol ratio) of an emulsion containing 70 mol% of AgBr, cubic, 0.49μm in mean grain size and 0.08 in coefficient of variation and an emulsion containing 70 mol% of AgBr, cubic, 0.34 μm in mean grain size and 0.10 in coefficient of variation), and further the following additives were added to prepare a sulfur sensitized emulsion. The above-described emulsified dispersion and this emulsion were mixed with each other to prepare a coating solution for a red-sensitive layer so as to have the following composition.

Coating solutions for blue- and green-sensitive layers were similarly prepared by dissolving the respective photographic materials described below in ethyl acetate, emulsifying and dispersing the resulting solution in a gelatin solution containing sodium dodecylbenzenesulfonate, and mixing the emulsified material with the silver halide emulsion for the respective layer.

AS a gelatin hardener for each layer, the sodium salt of 1-oxy-3,5-dichloro-s-triazine was used.

As color sensitizing dyes for the respective layers, the following dyes were used.

Dyes for Blue-Sensitive Emulsion Layer

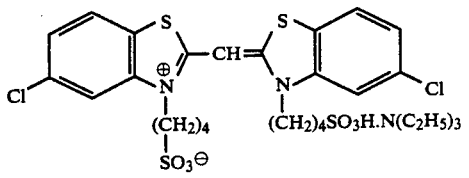

($5.0\times10^{-4}$ mol per mol of silver halide)

Dyes for Green-Sensitive Emulsion Layer

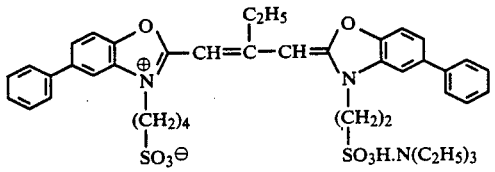

($4.0\times10^{-4}$ mol per mol of silver halide and

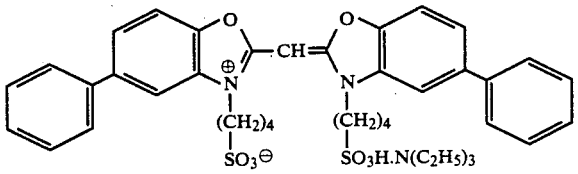

($7.0\times10^{-5}$ mol per mol of silver halide)

Dye for Red-Sensitive Emulsion Layer

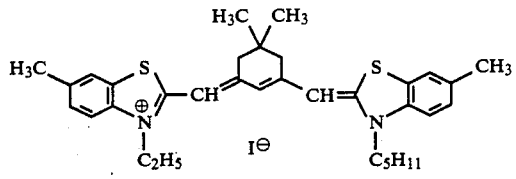

($0.9\times10^{-4}$ mol per mol of silver halide)

To the red-sensitive emulsion layer was added the following compound in an amount of $2.6\times10^{-3}$ mol per mol of silver halide:

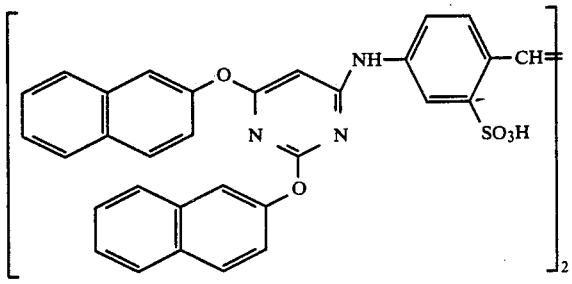

Further, 1-(5-methylureidophenyl)-5-mercaptotetrazole was added to the blue-sensitive emulsion layer, the green-sensitive emulsion layer and the red-sensitive emulsion layer in amounts of $4.0\times10^{-6}$ mol, $3.0\times10^{-5}$ mol and $1.0\times10^{-5}$ mol per mol of silver halide, respectively, and 2-methyl-5-t-octylhydroquinone was added to the blue-sensitive emulsion layer, the green-sensitive emulsion layer and the red-sensitive emulsion layer in amounts of $8\times10^{-3}$ mol, $2\times10^{-2}$ mol and $2\times10^{-2}$ mol per mol of silver halide, respectively.

Furthermore, 4-hydroxy-6-methyl-1,3,3a,7-tetraazaindene was added to the blue-sensitive emulsion layer and the green-sensitive emulsion layer in amounts of $1.2\times10^{-2}$ mol and $1.1\times10^{-2}$ mol per mol of silver halide, respectively.

In addition, the following mercaptoimidazole and mercaptothiadiazole were added to the red-sensitive emulsion layer in amounts of $2\times10^{-4}$ and $4\times10^{-4}$ mol per mol of silver halide, respectively.

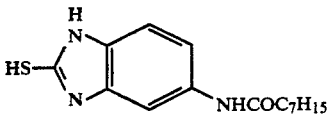

and

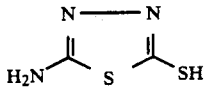

The following dyes were added in amounts of 5 mg/m² and 10 mg/m², respectively, to each emulsion layers for prevention of irradiation:

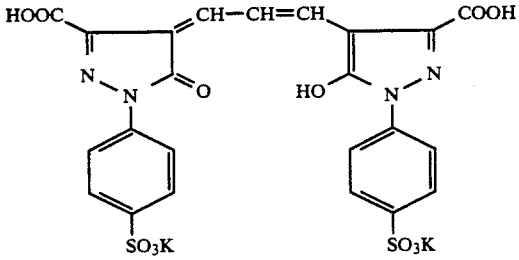

and

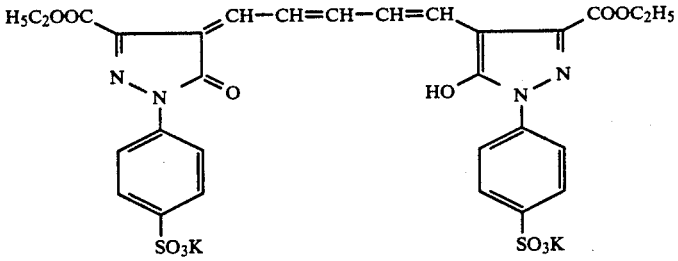

Layer Constitution

The composition of each layer for a sample designated as Sample 301 is hereinafter shown. Numerals indicate coated weights (g/m²). For the silver halide emulsions, numerals indicate coated weights converted to silver.

Support

Paper laminated with polyethylene (polyethylene on the side of the first layer containing a white pigment ($TiO_2$) and a bluing dye (ultramarine))

| | |
|---|---|
| First Layer (Blue-Sensitive Layer) | |
| Silver Chlorobromide Emulsion Described Above (AgBr: 80 mol %) | 0.26 |
| Gelatin | 1.83 |
| Yellow Coupler (ExY) | 0.83 |
| Color Image Stabilizer (Cpd-1) | 0.19 |
| Color Image Stabilizer (Cpd-7) | 0.08 |
| Solvent (Solv-3) | 0.18 |
| Solvent (Solv-6) | 0.18 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Layer) | |
| Silver Chlorobromide Emulsion (a 1:1 mixture (Ag mol ratio) of an emulsion containing 90 mol % of AgBr, cubic, 0.47 μm in mean grain size and 0.12 in coefficient of variation and an emulsion containing 90 mol % of AgBr, cubic, 0.36 μm in mean grain size and 0.09 in coefficient of variation) | 0.16 |
| Gelatin | 1.79 |
| Magenta Coupler (ExM) | 0.32 |
| Color Image Stabilizer (Cpd-2) | 0.02 |
| Color Image Stabilizer (Cpd-3) | 0.20 |
| Color Image Stabilizer (Cpd-4) | 0.01 |
| Color Image Stabilizer (Cpd-8) | 0.03 |
| Color Image Stabilizer (Cpd-9) | 0.04 |
| Solvent (Solv-2) | 0.65 |
| Fourth Layer (Ultraviolet Light Absorbing Layer) | |
| Gelatin | 1.58 |
| Ultraviolet Light Absorber (UV-1) | 0.47 |
| Color Mixing Inhibitor (Cpd-5) | 0.05 |
| Solvent (Solv-5) | 0.24 |
| Fifth Layer (Red-Sensitive Layer) | |
| Silver Chlorobromide Emulsion (a 1:2 mixture (Ag mol ratio) of an emulsion containing 70 mol % of AgBr, cubic, 0.49 μm in mean grain size and 0.08 in coefficient of variation and an emulsion containing 70 mol % of AgBr, cubic, 0.34 μm in mean grain size and 0.10 in coefficient of variation) | 0.23 |
| Gelatin | 1.34 |

-continued

| | |
|---|---|
| Cyan Coupler (ExC) | 0.30 |
| Color Image Stabilizer (Cpd-6) | 0.17 |
| Hydrophobic Polymer (P-2) | 0.40 |
| Color Image Stabilizer (Cpd-10) | 0.04 |
| Solvent (Solv-6) | 0.20 |
| Sixth Layer (Ultraviolet Light Absorbing Layer) | |
| Gelatin | 0.53 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.33 |
| Acrylic Modified Copolymer of Polyvinyl Alcohol (degree of modification: 17%) | 0.17 |
| Liquid Paraffin | 0.03 |

(Cpd-1) Color Image Stabilizer

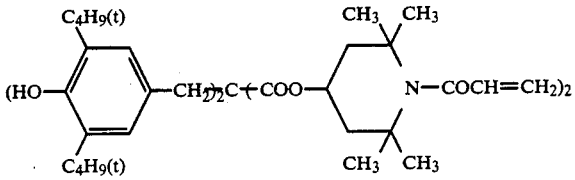

(Cpd-2) Color Image Stabilizer

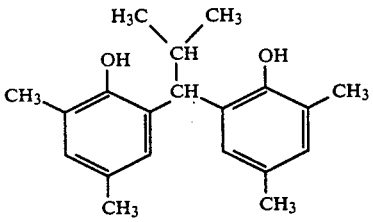

(Cpd-3) Color Image Stabilizer

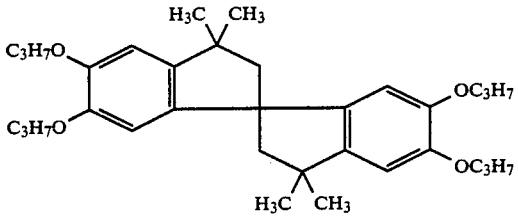

(Cpd-4) Color Image Stabilizer

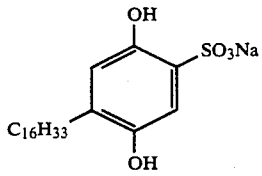

(Cpd-5) Color Mixing Inhibitor

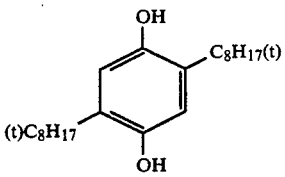

(Cpd-6) Color Image Stabilizer

A 2:4:4 mixture (weight ratio) of

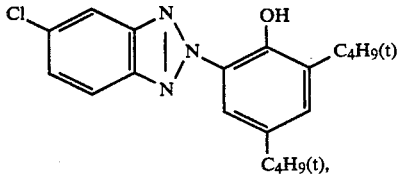

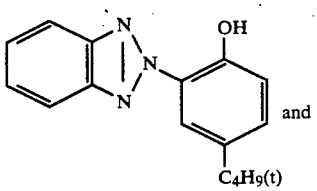

and

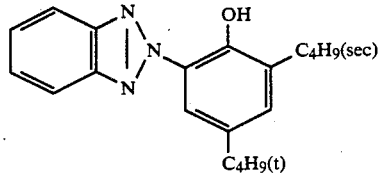

(Cpd-7) Color Image Stabilizer

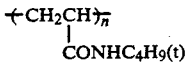

(molecular weight: 50,000)

(Cpd-8) Color Image Stabilizer

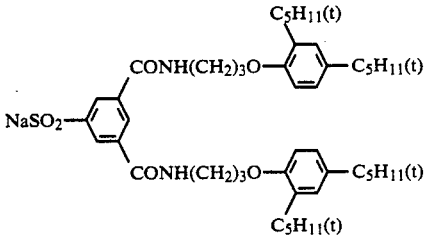

(Cpd-9) Color Image Stabilizer
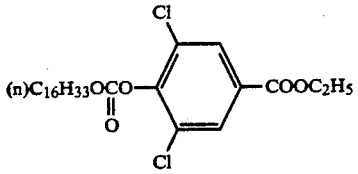
(Cpd-10) Color Image Stabilizer
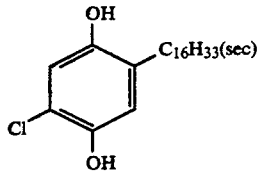
(UV-1) Ultraviolet Light Absorber
A 4:2:4 mixture (weight ratio) of
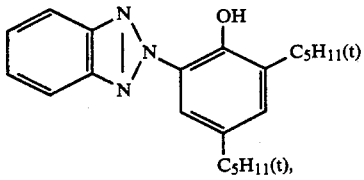
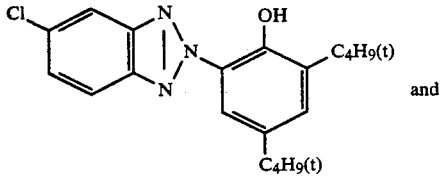
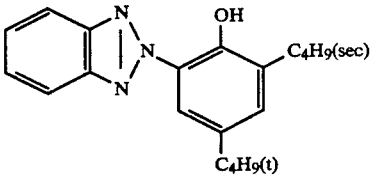
(Solv-1) Solvent
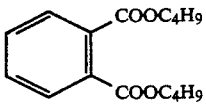
(Solv-2) Solvent
A 2:1 mixture (volume ratio) of
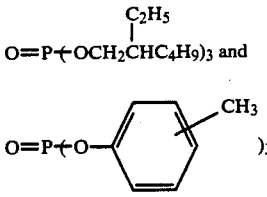
(Solv-3) Solvent
(Solv-4) Solvent
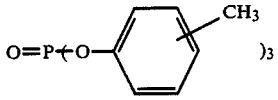
(Solv-5) Solvent
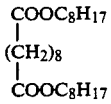
(Solv-6)Solvent
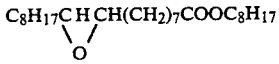
(ExY) Yellow Coupler
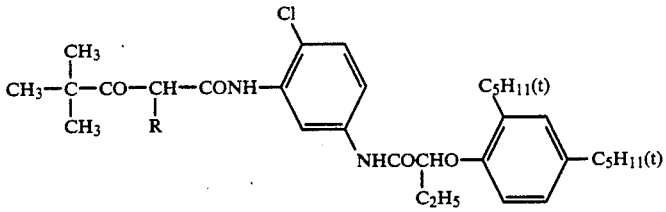
A 1:1 mixture (mol ratio) of
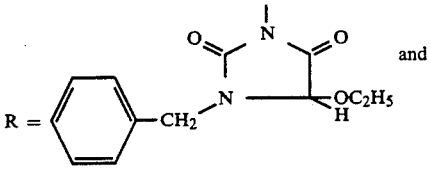
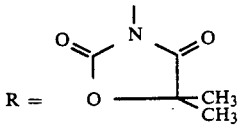

(ExM) Magenta Coupler

A 1:1 mixture (mol ratio) of

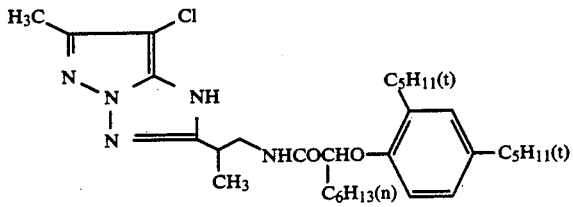

and

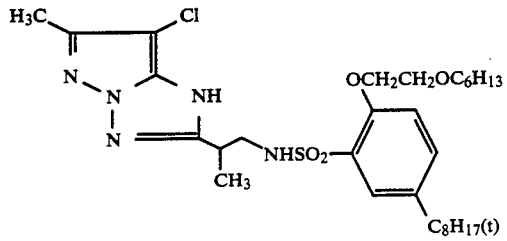

(ExC) Cyan Coupler

A 1:1 mixture (mol ratio) of

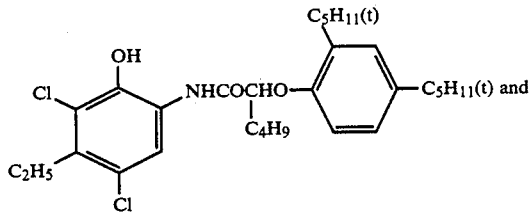

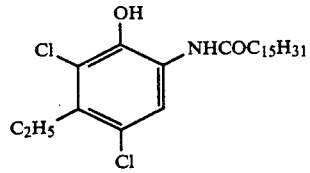

Samples 302 to 308 were prepared in the same manner as with the above Sample 301, except that the hydrophobic organic materials (except ethyl acetate) contained in the red-sensitive emulsion layer and the method for preparing the coating solution were replaced with the materials and the methods shown in Table 3.

TABLE 3

| Sample | Solution I (hydrophobic polymer latex) | Solution II (coupler solution) | Emulsi-* fying Method | Remark |
|---|---|---|---|---|
| 301 | Hydrophobic polymer (P-2) 40.0 g Coupler solvent (Solv-6) 20.0 g Color image stabilizer (Cpd-10) 4.0 g | Cyan coupler (ExC) 30.0 g Color image stabilizer (Cpd-6) 17.0 g | A | Invention |
| 302 | Hydrophobic polymer (P-2) 40.0 g | Cyan coupler (ExC) 30.0 g Color image stabilizer (Cpd-6) 17.0 g Coupler solvent (Solv-6) 20.0 g Color image stabilizer (Cpd-10) 4.0 g | A | Invention |
| 303 | Hydrophobic polymer (P-2) 40.0 g Coupler solvent (Solv-6) 20.0 g Color image stabilizer (Cpd-10) 4.0 g | Cyan coupler (ExC) 30.0 g Color image stabilizer (Cpd-6) 17.0 g | B | Comparison |
| 304 | Hydrophobic polymer (P-2) 40.0 g | Cyan Coupler (ExC) 30.0 g Color image stabilizer (Cpd-6) 17.0 g Coupler solvent (Solv-6) 20.0 g Color image stabilizer (Cpd-10) 4.0 g | B | Comparison |
| 305 | — (free from hydrophobic organic material) | Cyan coupler (ExC) 30.0 g Color image stabilizer (Cpd-6) 17.0 g Coupler solvent (Solv-6) 20.0 g Color image stabilizer (Cpd-10) 4.0 g Hydrophobic polymer (P-2) 40.0 g | C | Comparison |
| 306 | — (free from hydrophobic organic material) | Cyan coupler (ExC) 30.0 g Color image stabilizer (Cpd-6) 17.0 g Coupler solvent (Solv-6) 20.0 g Color image stabilizer (Cpd-10) 4.0 g | C | Comparison |
| 307 | Hydrophobic polymer (H)** 40.0 g | Cyan coupler (ExC) 30.0 g Color image stabilizer (Cpd-6) 17.0 g Coupler solvent (Solv-6) 20.0 g Color image stabilizer (Cpd-10) 4.0 g | D | Comparison |
| 308 | Hydrophobic polymer (P-2) 40.0 g | Cyan coupler (ExC) 30.0 g Color image stabilizer (Cpd-6) 17.0 g Coupler solvent (Solv-6) 20.0 g Color image stabilizer (Cpd-10) 4.0 g | E | Comparison |

* Emulsifying Method Emulsifying Method A:

The method described above for the preparation of the water-in-oil emulsion of coupler in Sample 301 Emulsifying Method B:

400 cc of a 20% aqueous gelatin solution was added to Solution I, and the resulting mixture was thoroughly stirred. Solution II was then added to the mixture, followed by stirring with a homogenizer to obtain an oil-in-water emulsion. Emulsifying Method C:

400 cc of a 20% aqueous gelatin solution was added to Solution I (provided that it did not contain hydrophobic polymer latex), and the resulting mixture was thoroughly stirred. Solution II was then added to the mixture, followed by stirring with a homogenizer to obtain an oil-in-water emulsion. Emulsifying Method D:

The cyan coupler, the color image stabilizers and the coupler solvent (totaling 71.0 g) were dissolved in 1,000 ml of acetone, and 550 g of Solution I (latex solution) (40.0 g of the hydrophobic polymer component) was added dropwise thereto over 1 minute. Acetone was removed under reduced pressure. (Method described in U.S. Pat. No. 4,203,716) Emulsifying Method E:

400 cc of a 20% aqueous gelatin solution was added to Solution II, followed by stirring with a homogenizer to obtain an oil-in-water emulsion. Solution I was then added to the resulting emulsion. ** Hydrophobic Polymer H:

Poly(sec-butylacrylate/sodium 3-acryloyloxy-propane-1-sulfonate/2-acetoacetoxyethylene methacrylate) (85/10/5) (The latex described in U.S. Pat. No. 4,203,716)

The stirring conditions of the homogenizer were established so that the emulsions having a mean grain size ranging from 0.13 to 0.16 μm could be finally obtained. According to Emulsifying Method A, the oil-in-water emulsion were prepared once through an emulsion in a stable water-in-oil state, whereas, according to Emulsifying Methods B and C, the oil-in-water emulsions were prepared without via a water-in-oil state.

The samples containing the oil-in-water emulsions thus formed were exposed according to the method described in Example 1.

As to the samples to which the exposure was completed, processing was carried out according to the following processing stages and using solutions of the following compositions and an automatic processor.

| Processing Stage | Temperature (°C.) | Time (minute) |
|---|---|---|
| Color Development | 37 | 3.5 |
| Bleaching-Fixing | 33 | 1.6 |
| Rinsing | 24–34 | 3 |
| Drying | 70–80 | 1 |

The composition of each processing solution was as follows.

Color Developing Solution

| | |
|---|---|
| Water | 800 ml |
| Diethylenetriaminepentaacetic Acid | 1.0 g |
| Nitrilotriacetic Acid | 2.0 g |
| Benzyl Alcohol | 15 g |
| Diethylene Glycol | 10 g |
| Sodium Sulfite | 2.0 g |
| Potassium Bromide | 1.0 g |
| Potassium Carbonate | 30 g |
| N-Ethyl-N-(β-methanesulfonamidoethyl)-3-methyl-4-aminoaniline Sulfate | 4.5 g |
| Hydroxylamine Sulfate | 3.0 g |
| Fluorescent Brightener (WHITEX 4B, Sumitomo Chemical Co., Ltd.) | 1.0 g |
| Water to make | 1,000 ml |
| pH (25° C.) | 10.25 |

Bleaching-Fixing Solution

| | |
|---|---|
| Water | 400 ml |
| Ammonium Thiosulfate (70%) | 150 ml |
| Sodium Sulfite | 18 g |
| Ethylenediaminetetraacetic Acid Fe(III) Ammonium | 55 g |
| Disodium Ethylenediaminetetraacetate | 5 g |
| Water to make | 1,000 ml |
| pH (25° C.) | 5.45 |

Using the samples thus obtained, the light fastness thereof was evaluated according to the method described in Example 1. The results are shown in Table 4.

TABLE 4

| Sample | Degree of Light Fading Xenon | Remark |
|---|---|---|
| 301 | 3.8 | Invention |
| 302 | 4.0 | Invention |
| 303 | 7.1 | Comparison |
| 304 | 7.3 | Comparison |
| 305 | 7.8 | Comparison |
| 306 | 9.8 | Comparison |
| 307 | 10.0 | Comparison |
| 308 | 9.8 | Comparison |

As apparent from the results shown in Table 4, Samples 301 and 302 of the present invention in which the hydrophobic polymer latexes and the cyan couplers were incorporated through the water-in-oil emulsions were more improved in light fading under high illuminance, compared to Samples 303 to 308 which did not pass through a state of water-in-oil emulsions. It can also be seen that Sample 307 containing the latex described in U.S. Pat. No. 4,203,716 was less improved compared to the samples containing no latex polymer.

As described above, by using the dispersions in which the polymer latexes and the cyan couplers are dispersed once through the water-in-oil emulsions, the silver halide color photographic materials prevented fading, which has previously occurred, when the cyan images after development are placed under high illuminance.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having a support and at least one hydrophilic colloid layer provided thereon, the hydrophilic colloid layer containing a dispersion obtained by dissolving a diffusion resistant oil-soluble cyan coupler which forms a substantially nondiffusible dye by coupling with an oxidation product of an aromatic primary amine developing agent and a hydrophobic polymer latex formed in an aqueous medium in each other, in which the polymer latex has a recurring unit represented by the following general formula I), the cyan coupler is represented by the following general formula (II) or (III), and the dispersion is formed through a water-in-oil emulsion at least once when the hydrophobic polymer latex formed in the aqueous medium is mixed with a solution of the cyan coupler in a coupler solvent:

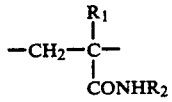

(I)

wherein $R_1$ represents a hydrogen atom, a halogen atom or a methyl group; and $R_2$ represents a substituted or unsubstituted aliphatic, aromatic or heterocyclic group;

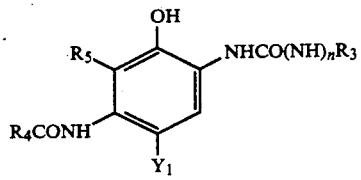

(II)

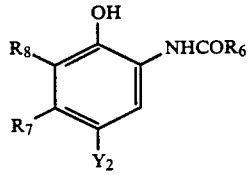

(III)

wherein $R_3$, $R_4$ and $R_6$ each represents a substituted or unsubstituted aliphatic, aromatic or heterocyclic group; $R_5$, $R_7$ and $R_8$ each represents a hydrogen atom, a halogen atom, an aliphatic group, an aromatic group or an acylamino group; $R_5$ may represent a nonmetallic atom which combines together with $R_4$ to form a nitrogen-containing 5-membered or 6-membered ring; $Y_1$ and $Y_2$ each represents a hydrogen atom or a group which is eliminable by coupling reaction with an oxidation product of a developing agent; and n represents 0 or 1.

2. A silver halide color photographic material as claimed in claim 1, wherein said hydrophobic polymer latex formed in the aqueous medium has a relative fluorescent quantum yield (K value) of at least 0.2.

3. A silver halide color photographic material as claimed in claim 1, wherein said hydrophobic polymer latex formed in the aqueous medium is crosslinked by a crosslinking group.

4. A silver halide color photographic material as claimed in claim 1, wherein said hydrophobic polymer latex formed in the aqueous medium contains the coupler solvent.

5. A silver halide color photographic material as claimed in claim 2, wherein said hydrophobic polymer latex formed in the aqueous medium is crosslinked by a crosslinking group.

6. A silver halide color photographic material as claimed in claim 2, wherein said hydrophobic polymer latex formed in the aqueous medium contains the coupler solvent.

7. A silver halide color photographic material as claimed in claim 3, wherein said hydrophobic polymer latex formed in the aqueous medium contains the coupler solvent.

8. A silver halide color photographic material as claimed in claim 1, wherein said support is a reflecting support.

* * * * *